US008934809B2

(12) United States Patent
Sato

(10) Patent No.: US 8,934,809 B2
(45) Date of Patent: Jan. 13, 2015

(54) IMAGE FORMING DEVICE CAPABLE OF RELIABLY COLLECTING MATTER DEPOSITED ON ENDLESS BELT IN STORAGE MEMBER AND FACILITATING MAINTENANCE OF STORAGE MEMBER

(71) Applicant: Shougo Sato, Seto (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/960,245

(22) Filed: Aug. 6, 2013

(65) Prior Publication Data

US 2014/0037322 A1 Feb. 6, 2014

(30) Foreign Application Priority Data

Aug. 6, 2012 (JP) ..... 2012-173850
Aug. 6, 2012 (JP) ..... 2012-173852

(51) Int. Cl.
*G03G 15/16* (2006.01)
*G03G 21/10* (2006.01)

(52) U.S. Cl.
CPC ..... *G03G 21/105* (2013.01); *G03G 15/168* (2013.01); *G03G 2215/0141* (2013.01)
USPC ..... 399/101

(58) Field of Classification Search
USPC ..... 399/91, 98, 99, 101, 107, 110, 121, 399/123, 297–299, 343, 345, 352
See application file for complete search history.

(56) References Cited

U.S. PATENT DOCUMENTS

| | | | | |
|---|---|---|---|---|
| 7,251,434 | B2 * | 7/2007 | Ikeda et al. | 399/101 |
| 7,392,007 | B2 * | 6/2008 | Nakano et al. | 399/345 |
| 8,180,265 | B2 * | 5/2012 | Takishita | 399/297 |
| 8,185,022 | B2 | 5/2012 | Sato | |
| 2009/0208245 | A1 | 8/2009 | Sato | |
| 2010/0209157 | A1 | 8/2010 | Sato et al. | |
| 2012/0213556 | A1 | 8/2012 | Sato | |

FOREIGN PATENT DOCUMENTS

| | | | |
|---|---|---|---|
| JP | H03-118589 | A | 5/1991 |
| JP | H03-259271 | A | 11/1991 |
| JP | H08-314348 | A | 11/1996 |
| JP | 2009-193007 | A | 8/2009 |
| JP | 2010-008472 | A | 1/2010 |
| JP | 2010-191012 | A | 9/2010 |

* cited by examiner

*Primary Examiner* — Hoan Tran
(74) *Attorney, Agent, or Firm* — Banner & Witcoff, Ltd.

(57) ABSTRACT

An image device includes: a cleaning member; a first case; a second case; a storage member; and a conveying unit. The storage member is provided outside of the second case and stores residual toner removed by the cleaning member. The first case includes a first case side coupling part. The second case includes an elastic member and a second case side coupling part. The second case side coupling part is coupled to the first case side coupling part through the elastic member. The elastic member allows the second case to move relative to the first case in a predetermined direction. The conveying unit includes a conveying unit side coupling part. The conveying unit side coupling part is coupled to the first case side coupling part.

19 Claims, 19 Drawing Sheets

IMAGE FORMING DEVICE CAPABLE OF RELIABLY COLLECTING MATTER DEPOSITED ON ENDLESS BELT IN STORAGE MEMBER AND FACILITATING MAINTENANCE OF STORAGE MEMBER

CROSS REFERENCE TO RELATED APPLICATION

This application claims priority from Japanese Patent Application No. 2012-173850 filed Aug. 6, 2012 and Japanese Patent Application No. 2012-173852 filed Aug. 6, 2012. The entire content of each of these priority applications is incorporated herein by reference.

TECHNICAL FIELD

The present invention relates to an image-forming device employing an electrophotographic system.

BACKGROUND

One electrophotographic image-forming device known in the art is a tandem-type color laser printer provided with four photosensitive drums corresponding to the four colors yellow, magenta, cyan, and black employed by the color printer, and an endless belt confronting the four photosensitive drums. One example of this type of tandem color laser printer that has been proposed includes a storage member below the endless belt for collecting waste toner removed from the belt.

However, the storage member is difficult to service when disposed beneath the endless belt. To remedy this problem, another color laser printer was proposed in which the storage member is positioned on the same side as the photosensitive drums, instead of underneath the endless belt. This color laser printer also includes a process frame for retaining the photosensitive drums that can be moved in and out of the main casing of the printer, a belt cleaner for contacting the conveying belt and removing waste toner therefrom, and a lift for conveying the waste toner toward the storage member. The storage member is also retained in the process frame.

However, in the color laser printer having this construction, the belt cleaner must be pivoted to separate the belt cleaning roller in the belt cleaner from the conveying belt when removing the process frame from the main casing and when transferring toner images onto sheets P. Consequently, there is potential for waste toner to separate from and fall off the belt cleaning roller when the roller is separated from the conveying belt.

Further, the belt cleaner in the cleaning unit of the conventional printer described above has a complex structure for separating the belt cleaner from the conveying belt when the process frame is pulled out of the printer. Therefore, studies were conducted on a structure that provides a waste toner collection chamber and a lift on the process frame and fixes the belt cleaner to the transfer unit, and more specifically to the follow roller side of the transfer unit.

However, with this construction, the belt cleaner may move in response to movement by the follow roller during operations of the transfer unit. In such cases, toner may leak through the region in which the lift is coupled to the belt cleaner.

SUMMARY

In view of the foregoing, it is an object of the present invention to provide an image-forming device that, through a simple construction, can reliably collect matter deposited on the endless belt in a storage member and that can facilitate maintenance of the storage member.

In order to attain the above and other objects, the present invention provides an image forming device comprising: a drive roller; a follow roller; an endless belt; a cleaning member; a first case; a second case; a storage member; and a conveying unit. The follow roller is spaced apart a predetermined distance from the drive roller. The endless belt is looped over the drive roller and the follow roller. The cleaning member is disposed to confront the follow roller with the endless belt interposed therebetween and is configured to remove residual toner on the endless belt. The first case is configured to support the drive roller. The first case includes a first case side coupling part. The second case is configured to support both the follow roller and the cleaning member and be movable relative to the first case in a predetermined direction. The second case includes an elastic member; and a second case side coupling part. The elastic member is elastically deformable. The second case side coupling part is coupled to the first case side coupling part through the elastic member that allows the second case to move relative to the first case in the predetermined direction. The storage member is provided outside of the second case and configured to store the residual toner removed by the cleaning member. The conveying unit is configured to convey the deposited matter removed by the cleaning member to the storage member. The conveying unit includes a conveying unit side coupling part. The conveying unit side coupling part is coupled to the first case side coupling part.

According to another aspect, the present invention provides an image forming device comprising: a main body; a plurality of developer accommodating members; a retaining member; a belt unit; a first cleaning unit; a storage member; and a conveying unit. The plurality of developer accommodating members is configured to accommodate developer. The retaining member is configured to retain the plurality of developer accommodating members and be movable between an internal position inside the main body and an external position outside the main body. The belt unit includes a first roller; a second roller; and an endless belt. The endless belt is looped around the first roller and the second roller The first cleaning unit includes a first cleaning member. The first cleaning member is fixedly positioned and configured to remove residual toner on the endless belt. The storage member is supported by the retaining member and configured to store the residual toner removed by the first cleaning unit. The conveying unit is configured to convey the residual toner removed by the first cleaning unit to the storage member and be movable between a first position and a second position. The conveying unit is coupled to the storage member and positioned along a path of the retaining member when the conveying unit is in the first position. The conveying unit is decoupled from the storage member and positioned no longer in the path of the retaining member when the conveying unit is in the second position.

According to still another aspect, the present invention provides an image forming device comprising: a main body; a plurality of photosensitive bodies; a retaining member; a belt unit; a first cleaning unit; a storage member; and a conveying unit. The plurality of photosensitive bodies is arranged in parallel to one another and spaced apart a predetermined distance between adjacent two photosensitive bodies. A developer image is formable on each of the plurality of photosensitive bodies. The retaining member is configured to retain the plurality of photosensitive bodies and be movable between an internal position inside the main body and an external position outside the main body. The belt unit includes a first roller, a second roller, and an endless belt. The second roller is arranged in parallel to the first roller and spaced apart a predetermined distance from the first roller in a first direction in which the plurality of photosensitive bodies is arranged. The endless belt is looped around the first roller and the second roller. The endless belt is configured to contact the plurality of photosensitive bodies when the retaining member is in the internal position whereas the endless belt is configured to separate from the plurality of photosensitive bodies when the retaining member is in the external position. The first cleaning unit includes a first cleaning member. The first cleaning member is fixedly positioned and configured to remove residual toner on the endless belt. The storage member is supported by the retaining member and configured to store the residual toner removed by the first cleaning unit. The conveying unit is configured to convey the residual toner removed by the first cleaning unit to the storage member. The conveying unit is further configured to be movable between a first position and a second position. The conveying unit is coupled to the storage member when the conveying unit is in the first position. The conveying unit is decoupled from the storage member when the conveying unit is in the second position. The second position si disposed nearer to the endless belt than the first position in a second direction in which the endless belt confronts each of the plurality of photosensitive bodies. The second direction is orthogonal to the first direction.

BRIEF DESCRIPTION OF THE DRAWINGS

The particular features and advantages of the invention as well as other objects will become apparent from the following description taken in connection with the accompanying drawings, in which:

FIGS. 3A and 3B are cross-sectional views of the transfer unit shown in FIG. 2; and in which FIG. 3A shows a cross-sectional view along a line A-A in FIG. 2; and FIG. 3B shows a cross-sectional view along a line B-B in FIG. 2;

FIGS. 4A and 4B are cross-sectional views of the transfer unit along a line C-C in FIG. 2; and in which FIG. 4A shows a state where a first conveying unit is disposed in a coupled position, and FIG. 4B shows a state where the first conveying unit is disposed in an uncoupled position;

FIGS. 12A and 12B are cross-sectional views of the transfer unit shown in FIG. 11; and in which FIG. 12A shows a cross-sectional view along a line A-A in FIG. 11; and FIG. 12B shows a cross-sectional view along a line B-B in FIG. 11;

FIGS. 13A and 13B are cross sectional views of the transfer unit along a line C-C in FIG. 11; and in which FIG. 13A shows a state where a lift is disposed in a first position; and FIG. 13B shows a state where the lift is disposed in a second position;

DETAILED DESCRIPTION

Figure 1:
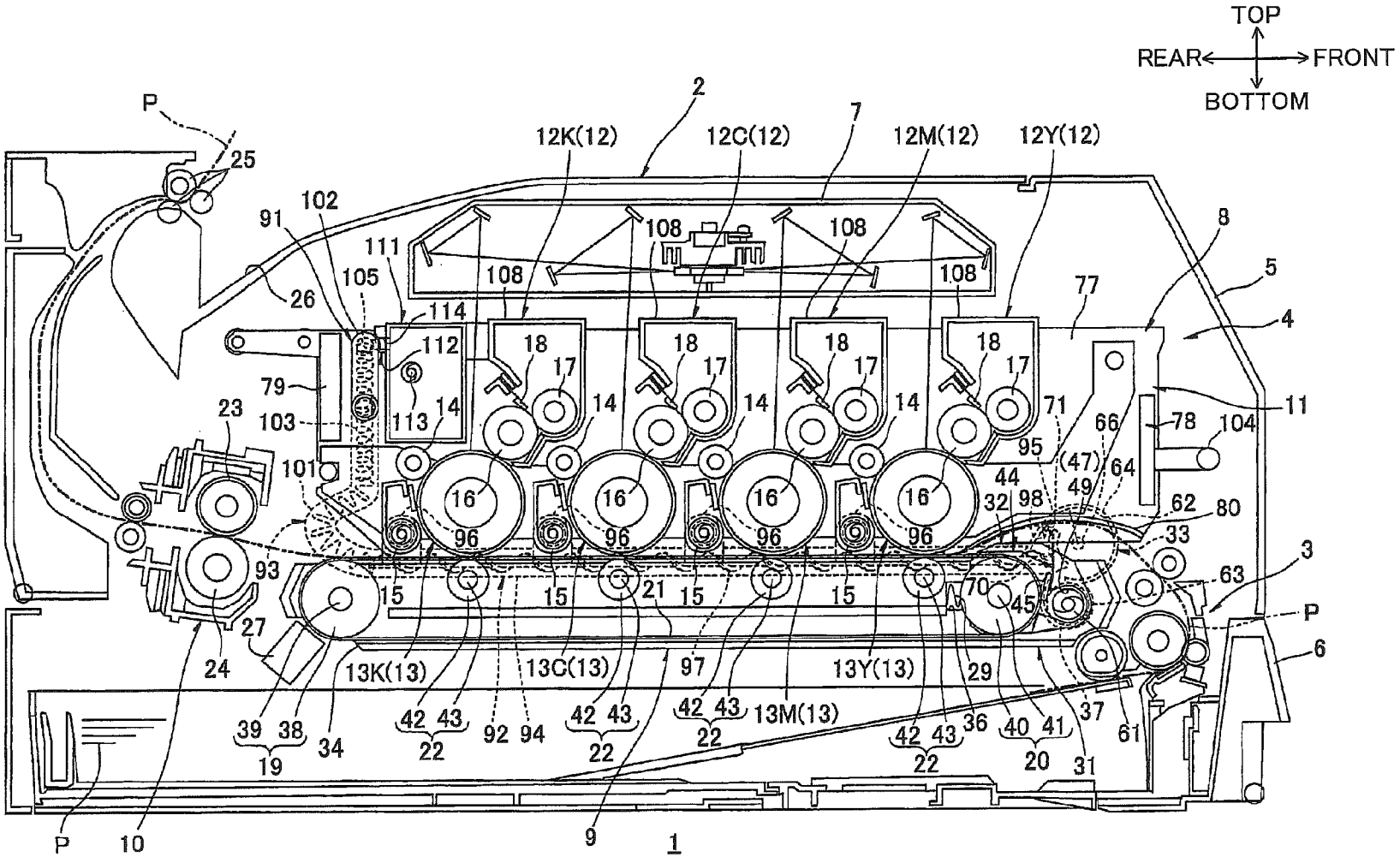
FIG. 1 is a vertical cross-sectional view of an image-forming device according to a first embodiment of the present invention.

An image-forming device according to embodiments of the present invention will be described while referring to the accompanying drawings wherein like parts and components are designated by the same reference numerals to avoid duplicating description.

<First Embodiment>

1. Overall Structure of a Printer

FIG. 1 shows a printer 1 serving as an example of the image-forming device according to the present invention. The printer 1 is a direct horizontal tandem-type color laser printer. The printer 1 includes a main casing 2 constituting the device body.

The main casing 2 is formed in a box-like shape that is generally rectangular in a side view. A front cover 5 is provided on one side of the main casing 2 for mounting and removing a process unit 8 described later.

Descriptions used in the following description in relation to the printer 1 will reference the state of the printer 1 when the printer 1 is resting on a flat surface. More specifically, the side of the printer 1 on which the front cover 5 is provided (the right side in FIG. 1) will be referred to as the "front side," and the opposite side (the left side in FIG. 1) as the "rear side," as indicated by the arrows in FIG. 1. Further, left and right sides of the printer 1 in the following description will be based on the perspective of the user facing the front side of the printer 1. Thus, the near side of the printer 1 in FIG. 1 will be considered the "left side," and the far side will be considered the "right side."

Within the main casing 2, the printer 1 also includes a sheet-feeding unit 3 for feeding sheets P of paper to be printed, and an image-forming unit 4 for forming images on the sheets P supplied by the sheet-feeding unit 3.

(1) Sheet-Feeding Unit

The sheet-feeding unit 3 is disposed in the bottom section of the main casing 2 and includes a paper tray 6 accommodating sheets P of paper, and a plurality of rollers for conveying the sheets P to the image-forming unit 4.

(2) Image-Forming Unit

The image-forming unit 4 includes a scanning unit 7, a process unit 8, a transfer unit 9, and a fixing unit 10.

(2-1) Scanning Unit

The scanning unit 7 is disposed in the top section of the main casing 2. The scanning unit 7 emits four laser beams toward respective photosensitive drums 13 (described later), the paths of which are depicted by solid lines in FIG. 1, thereby exposing the photosensitive drums 13.

(2-2) Process Unit

The process unit 8 is disposed beneath the scanning unit 7 and above the transfer unit 9. The process unit 8 includes four developer cartridges 12 corresponding to the four colors used in image formation, and a process frame 11 for retaining the developer cartridges 12.

Figure 9:
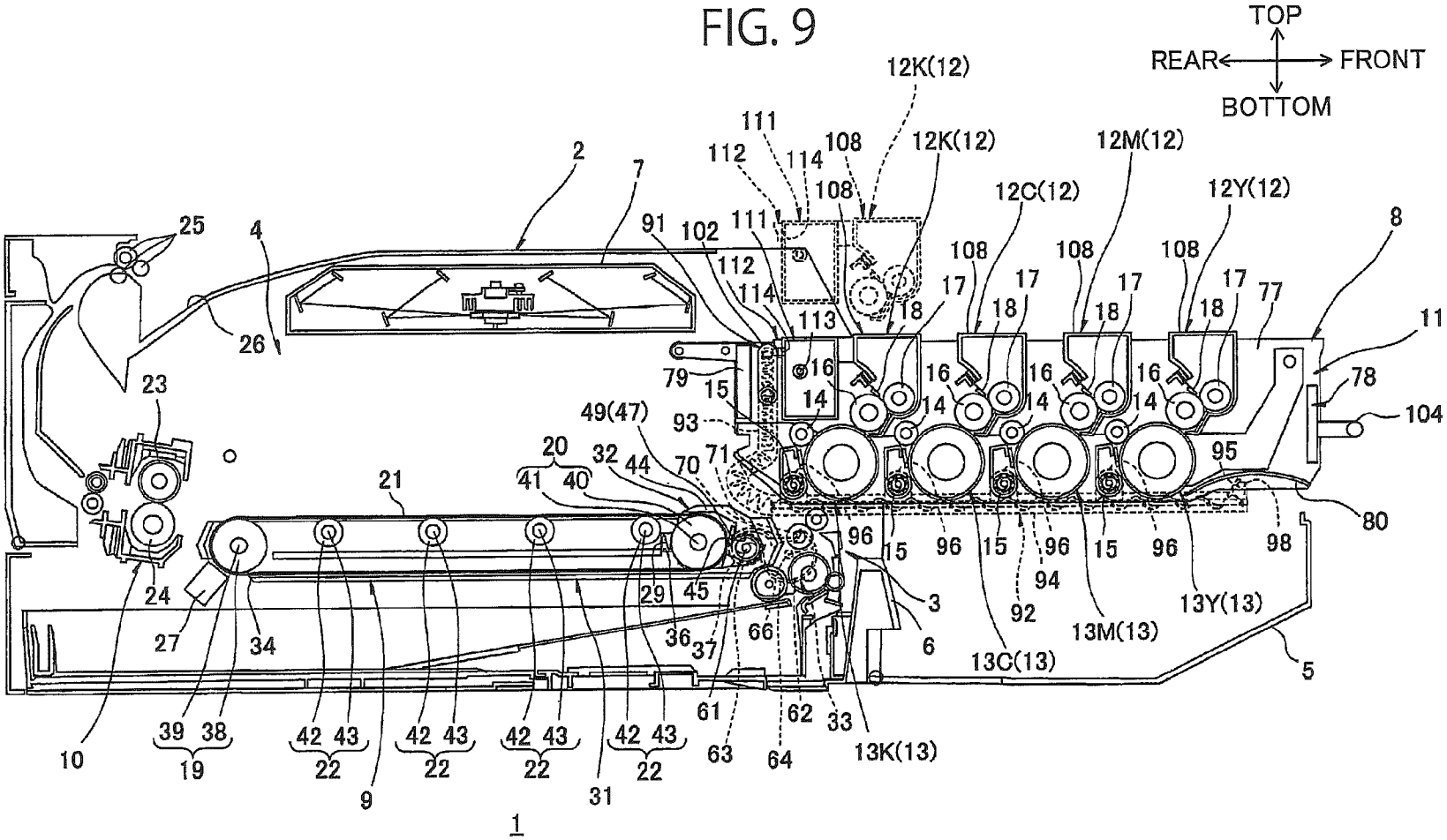
FIG. 9 is an explanatory diagram showing a state where the process unit shown in FIG. 1 is disposed in an external position.

The process frame 11 can move relative to the main casing 2 in the front-rear direction between an internal position (see FIG. 1) and an external position (see FIG. 9). In the internal position, the process frame 11 is accommodated inside the main casing 2. In the external position, the process frame 11 is withdrawn to the outside of the main casing 2.

The process frame 11 retains four each of photosensitive drums 13, charging rollers 14, and drum cleaning units 15.

The four photosensitive drums 13 corresponding to the four printing colors are arranged parallel to one another and spaced at intervals in the front-rear direction. Specifically, the photosensitive drums 13 include a yellow photosensitive drum 13Y, a magenta photosensitive drum 13M, a cyan photosensitive drum 13C, and a black photosensitive drum 13K arranged in the order given from the front side toward the rear side. The photosensitive drums 13 are generally cylindrical in shape and are oriented with their axes aligned in the left-right direction (longitudinal direction).

The charging rollers 14 are disposed on the upper rear side of corresponding photosensitive drums 13, contacting the upper rear sides of the photosensitive drums 13 with pressure. The charging rollers 14 are generally cylindrical in shape with their axes aligned in the left-right direction.

The drum cleaning units 15 are disposed on the rear sides of the corresponding photosensitive drums 13 and below the corresponding charging rollers 14. The drum cleaning units 15 contact the photosensitive drums 13 from the rear sides thereof and function to clean the surfaces of the photosensitive drums 13, as will be described later in greater detail.

The four developer cartridges 12 are provided to correspond with the four photosensitive drums 13 and are arranged parallel to one another and spaced apart at intervals in the front-rear direction. Specifically, the developer cartridges 12 include a yellow developer cartridge 12Y, a magenta developer cartridge 12M, a cyan developer cartridge 12C, and a black developer cartridge 12K arranged in the order given from front to rear. The developer cartridges 12 are formed in a box-like shape elongated in the left-right direction and are detachably mounted in the process frame 11 so as to be positioned on the upper front side of the corresponding photosensitive drums 13.

Each developer cartridge 12 includes a developing roller 16.

The developing roller 16 is rotatably supported in the lower portion of the developer cartridge 12. The developing roller 16 is exposed in the rear side of the developer cartridge 12 and contacts the upper front side of the corresponding photosensitive drum 13.

Each developer cartridge 12 also includes a supply roller 17 that contacts the upper front side of the corresponding developing roller 16, and a thickness-regulating blade 18 that contacts the top of the corresponding developing roller 16. Each developer cartridge 12 has space formed above the supply roller 17 and thickness-regulating blade 18 for accommodating toner.

(2-3) Transfer Unit

The transfer unit 9 is disposed in the main casing 2 at a position above the sheet-feeding unit 3 and beneath the process unit 8. The transfer unit 9 includes a drive roller 19, a follow roller 20, an endless conveying belt 21, and four transfer rollers 22.

The drive roller 19 and follow roller 20 are arranged parallel to each other and are separated in the front-rear direction.

The endless conveying belt 21 is looped around the drive roller 19 and follow roller 20, with the upper portion of the endless conveying belt 21 in contact with the bottom sides of the photosensitive drums 13. Thus, the drive roller 19 and follow roller 20 are in contact with the inner surface of the endless conveying belt 21. Hence, when the drive roller 19 is driven to rotate, the endless conveying belt 21 circulates so that its upper portion moves rearward, and the follow roller 20 rotates along with the circulating movement of the endless conveying belt 21.

Each of the transfer rollers 22 is disposed in confrontation with a corresponding photosensitive drum 13, with the upper portion of the endless conveying belt 21 interposed between the top of each transfer roller 22 and the bottom of the corresponding photosensitive drum 13.

A patch sensor 27 is also provided in the main casing 2 on the lower rear side of the drive roller 19.

(2-4) Fixing Unit

The fixing unit 10 is disposed on the rear side of the transfer unit 9. The fixing unit 10 includes a heating roller 23, and a pressure roller 24 that contacts and applies pressure to the bottom side of the heating roller 23.

(3) Image-Forming Operation

Toner in each of the developer cartridges 12 is supplied onto the corresponding supply roller 17, and the supply roller 17 in turn supplies the toner onto the corresponding developing roller 16 while the toner is tribocharged between the supply roller 17 and developing roller 16.

The thickness-regulating blade 18 regulates the thickness of toner supplied to the developing roller 16 as the developing roller 16 rotates, maintaining the toner carried on the surface of the developing roller 16 at a thin uniform thickness.

In the meantime, the charging roller 14 applies a uniform charge to the surface of the corresponding photosensitive drum 13. Subsequently, the photosensitive drum 13 is exposed by the scanning unit 7, forming an electrostatic latent image on the surface of the photosensitive drum 13 based on image data.

The toner carried on the developing roller 16 is then supplied to the latent image formed on the photosensitive drum 13 to produce a toner image thereon.

The various rollers constituting the sheet-feeding unit 3 rotate to convey a sheet P from the paper tray 6 along a U-shaped path that changes the conveying direction from a forward direction to a diagonally rearward and upward direction. The rollers supply one sheet P at a time toward the image-forming unit 4 (between the photosensitive drums 13 and the endless conveying belt 21) at a prescribed timing.

The endless conveying belt 21 subsequently conveys the sheet P rearward so that the sheet P passes sequentially between the photosensitive drums 13 and corresponding transfer rollers 22. At this time, toner images carried on the photosensitive drums 13 are transferred to the sheet P to form an image thereon.

Next, the sheet P is subjected to heat and pressure while passing between the heating roller 23 and pressure roller 24 of the fixing unit 10, thereby fixing the image to the sheet P.

Subsequently, the sheet P is conveyed along a U-shaped path that changes the conveying direction from a rearward direction to a direction diagonally upward and forward. Discharge rollers 25 disposed at the top of the conveying path discharge the sheet P onto a discharge tray 26 formed on the top surface of the main casing 2.

2. Detailed Structure of the Transfer Unit

Figure 2:
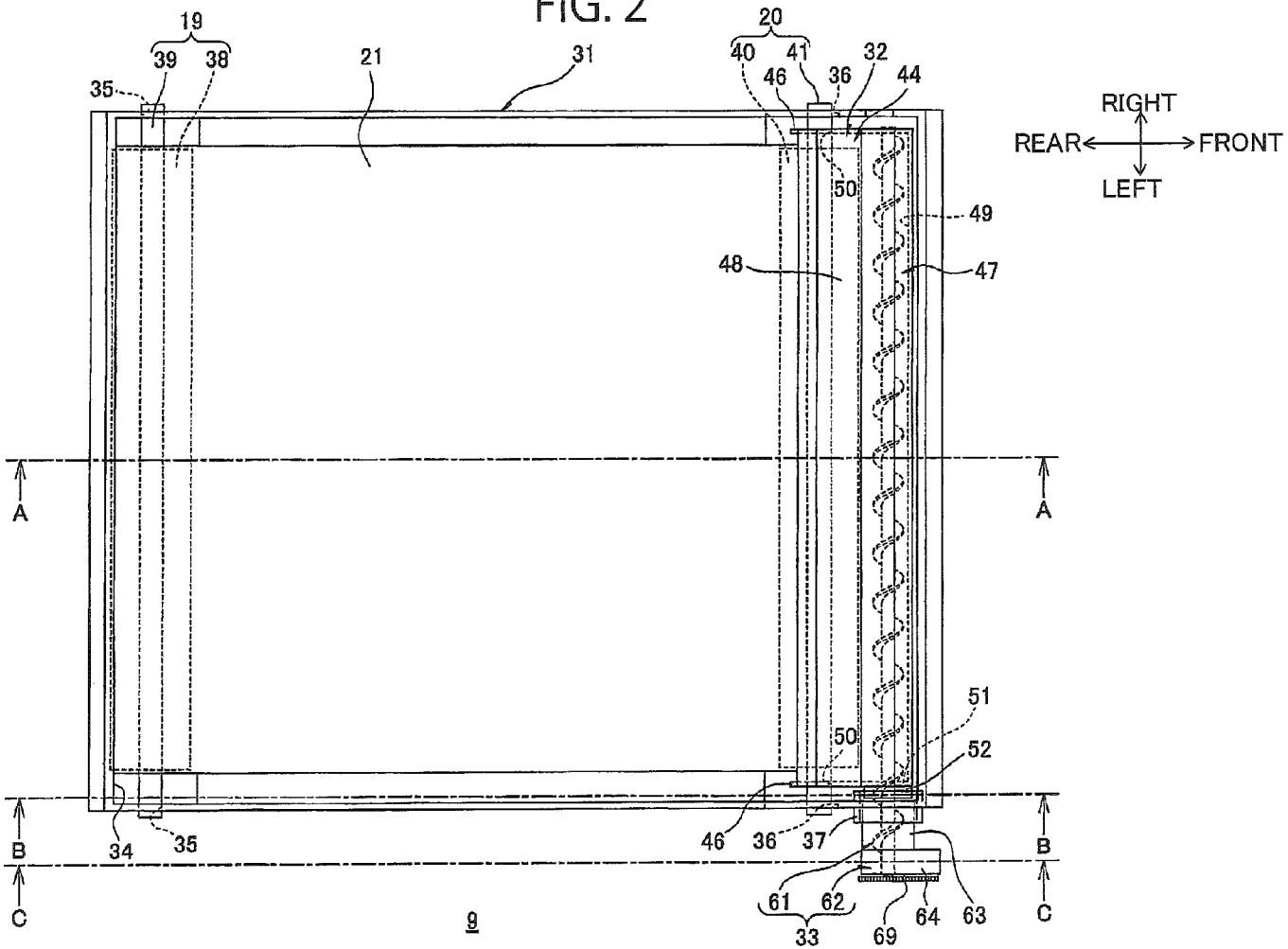
FIG. 2 is a plan view of a transfer unit shown in FIG. 1.
Figure 3A:
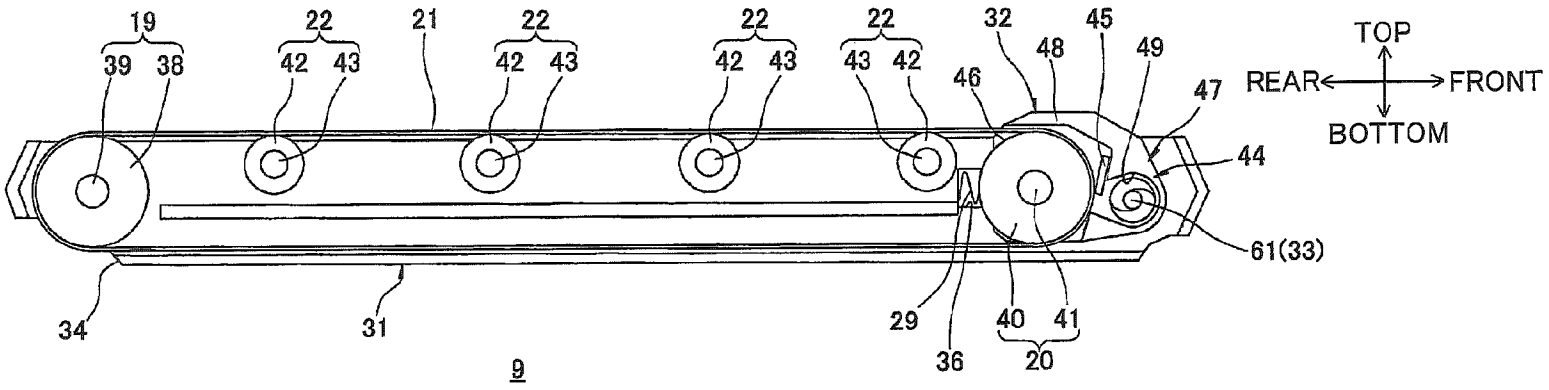

As shown in FIGS. 2 and 3, the transfer unit 9 is provided with a transfer frame 31, a belt cleaner 32, and a first conveying unit 33.

(1) Transfer Frame

As shown in FIGS. 2 and 4, the transfer frame 31 has a frame-like structure with a closed bottom and is generally rectangular in a plan view. The transfer frame 31 includes an exposure opening 34, drive-roller-shaft insertion holes 35, follow-roller-shaft insertion openings 36, and a support part 37.

The exposure opening 34 is formed in the bottom portion of the transfer frame 31 at the rear end thereof and extends across the entire left-right dimension of the transfer frame 31. The exposure opening 34 is formed in an area confronting the patch sensor 27 provided in the main casing 2 (see FIG. 1).

The drive-roller-shaft insertion holes 35 are generally circular in a side view and formed in the rear end of the transfer frame 31, with one drive-roller-shaft insertion hole 35 penetrating each of the left and right side walls thereof. The drive-roller-shaft insertion holes 35 have a diameter approximately equivalent to (slightly larger than) the major diameter of a drive roller shaft 39 described later.

The follow-roller-shaft insertion openings 36 have a general rectangular shape in a side view that is elongated in the front-rear direction, and penetrate the left and right side walls of the transfer frame 31 near the front ends thereof. The follow-roller-shaft insertion openings 36 have a vertical dimension that is approximately equivalent to (slightly larger than) the major diameter of a follow roller shaft 41 described later. A compression spring 29 is provided inside each of the follow-roller-shaft insertion openings 36.

The compression spring 29 is a compression coil spring that extends in the front-rear direction. The rear end of the compression spring 29 is anchored to the inner surface on the rear side of the corresponding follow-roller-shaft insertion opening 36.

The support part 37 is provided on the left wall of the transfer frame 31 near the front end thereof and is positioned forward of the follow-roller-shaft insertion opening 36. The support part 37 is generally cylindrical in shape and elongated in the left-right direction so as to penetrate the left wall of the transfer frame 31. The support part is provided with a support-part-side sealing member 30 (see FIG. 5).

Figure 5:
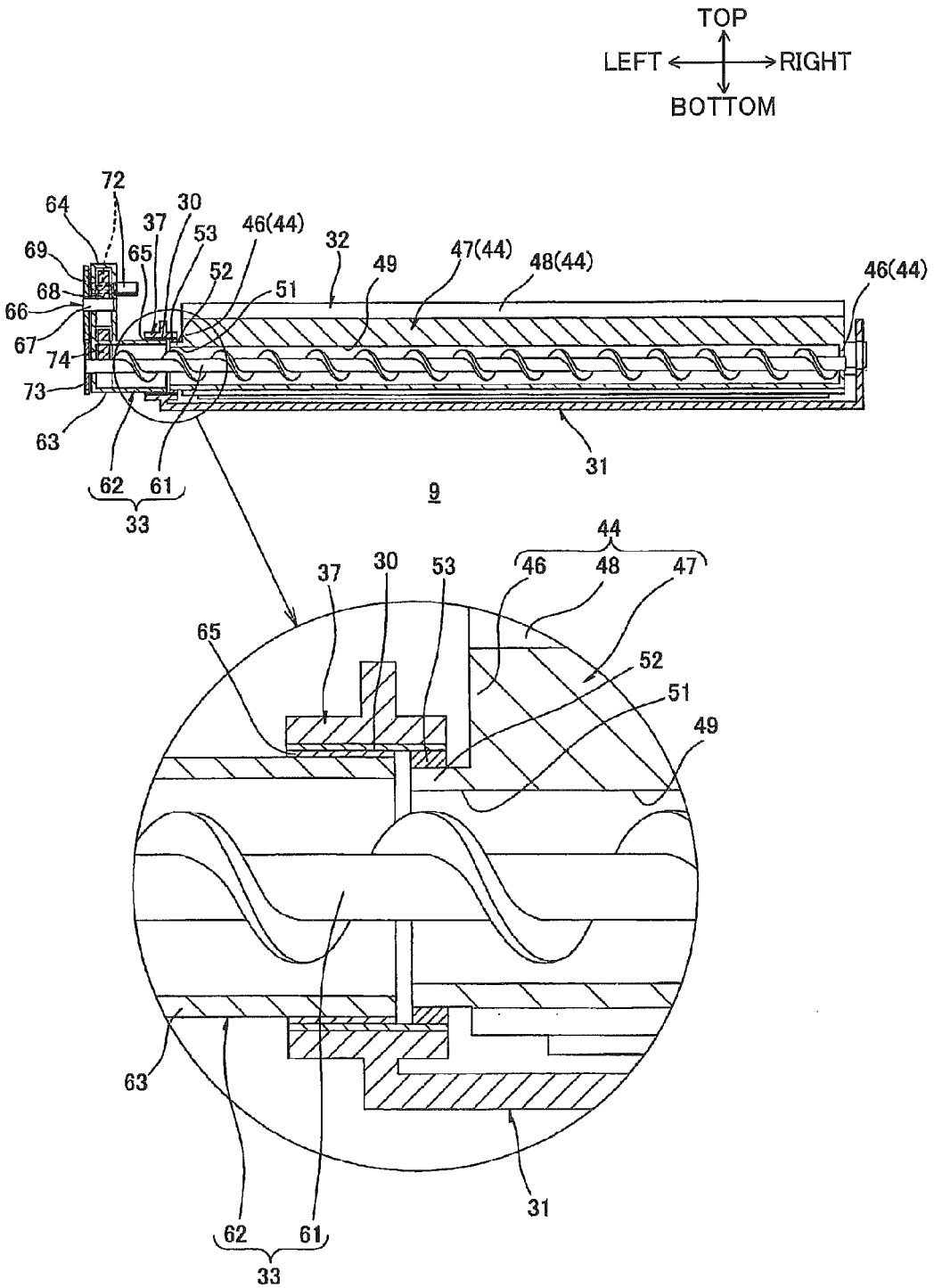
FIG. 5 is a cross-sectional view of the transfer unit along a D-D line in FIG. 4A.

As shown in FIG. 5, the support-part-side sealing member 30 is affixed to the inner peripheral surface of the support part 37 so as to cover the entire inner peripheral surface thereof. The support-part-side sealing member 30 is formed of an elastic material such as a sponge or nonwoven fabric.

As shown in FIGS. 2 and 3, the transfer frame 31 supports the drive roller 19, the follow roller 20, the four transfer rollers 22, and the endless conveying belt 21.

The drive roller 19 includes a drive roller body 38, and a drive roller shaft 39.

The drive roller body 38 has a generally cylindrical shape that is elongated in the left-right direction and is retained in the transfer frame 31 so that its top peripheral portion is positioned above the top of the transfer frame 31. The lower rear peripheral portion of the drive roller body 38 is exposed in the lower rear portion of the transfer frame 31 through the exposure opening 34. The left-right length of the drive roller body 38 is slightly shorter than the left-right dimension of the endless conveying belt 21.

The drive roller shaft 39 is inserted through the drive roller body 38 such that the left and right ends of the drive roller shaft 39 are exposed on the outside of the drive roller body 38. The drive roller shaft 39 is generally rod-shaped, with its longitudinal dimension aligned with the central axis of the drive roller body 38. The left-right length of the drive roller shaft 39 is greater than the left-right dimension of the endless conveying belt 21. Both left and right ends of the drive roller shaft 39 are fixed to the drive roller body 38 by flange members (not shown) so that the drive roller shaft 39 cannot rotate relative to the drive roller body 38.

Figure 4A:
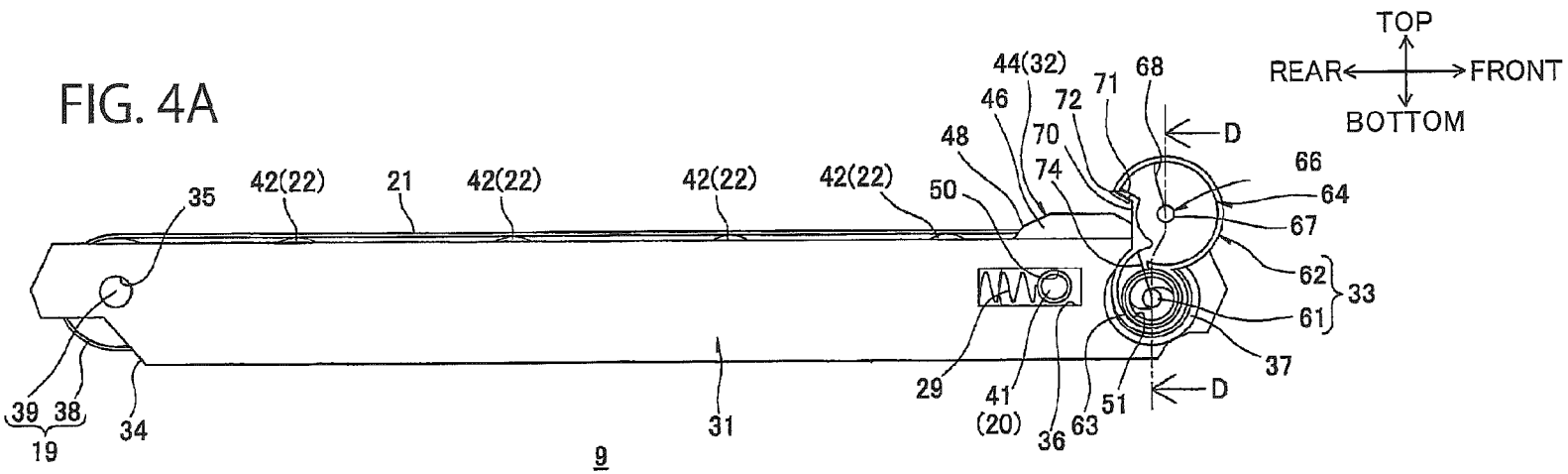

The left and right ends of the drive roller shaft 39 are rotatably inserted into the corresponding drive-roller-shaft insertion holes 35 formed in the left and right sides of the transfer frame 31 (see FIG. 4A).

The follow roller 20 includes a follow roller body 40, and a follow roller shaft 41.

The follow roller body 40 is generally cylindrical in shape and elongated in the left-right direction. The follow roller body 40 has the same diameter as the drive roller body 38 and is retained in the transfer frame 31 such that its top peripheral portion is disposed at approximately the same vertical position as the top peripheral portion of the drive roller body 38. The left-right length of the follow roller body 40 is slightly shorter than the left-right dimension of the endless conveying belt 21.

The follow roller shaft 41 is inserted through the follow roller body 40 such that both left and right ends are exposed on the outside thereof. The follow roller shaft 41 is generally rod-shaped, with its longitudinal dimension oriented along the central axis of the follow roller body 40. The left-right length of the follow roller shaft 41 is greater than the left-right dimension of the endless conveying belt 21. Both left and right ends of the follow roller shaft 41 are fixed to the left and right ends of the follow roller body 40 with flange members (not shown) so that the follow roller shaft 41 is incapable of rotating relative to the follow roller body 40.

The left and right ends of the follow roller shaft 41 are inserted into the corresponding follow-roller-shaft insertion openings 36 formed in the left and right sides of the transfer frame 31 and are capable of both rotating and moving forward and rearward within the follow-roller-shaft insertion openings 36 (see FIG. 4A).

Further, the left and right ends of the follow roller shaft 41 contact the front ends of the compression springs 29 in the corresponding follow-roller-shaft insertion openings 36 from the front sides thereof (see FIG. 4A). Thus, the elastic force of the compression springs 29 constantly urges the follow roller 20 forward.

Each of the transfer rollers 22 is configured of a transfer roller body 42, and a transfer roller shaft 43.

The transfer roller body 42 is generally cylindrical in shape and elongated in the left-right direction. The transfer roller body 42 is formed of an electrically conductive resin material and has a smaller outer diameter than the outer diameters of the drive roller body 38 and follow roller body 40. The transfer rollers 22 are retained in the transfer frame 31 so that the top peripheral portions of the transfer roller bodies 42 are at substantially the same vertical position as the top peripheral portion of the drive roller body 38.

The transfer roller shaft 43 is formed of a metal in a general rod shape whose longitudinal dimension is oriented along the central axis of the transfer roller body 42.

The endless conveying belt 21 is formed of an electrically conductive resin material. The endless conveying belt 21 is a wide belt formed in a continuous loop having sufficient length to be placed around the drive roller 19 and follow roller 20.

(2) Belt Cleaner

The belt cleaner 32 is disposed inside the front end of the transfer frame 31. The belt cleaner 32 includes a cleaner frame 44, and a cleaning blade 45.

The cleaner frame 44 is formed in a generally cylindrical shape that is closed on both left and right ends and open on the lower rear side. More specifically, the cleaner frame 44 is integrally provided with a pair of left and right side walls 46, a main body 47, and a top wall 48.

Figure 3B:
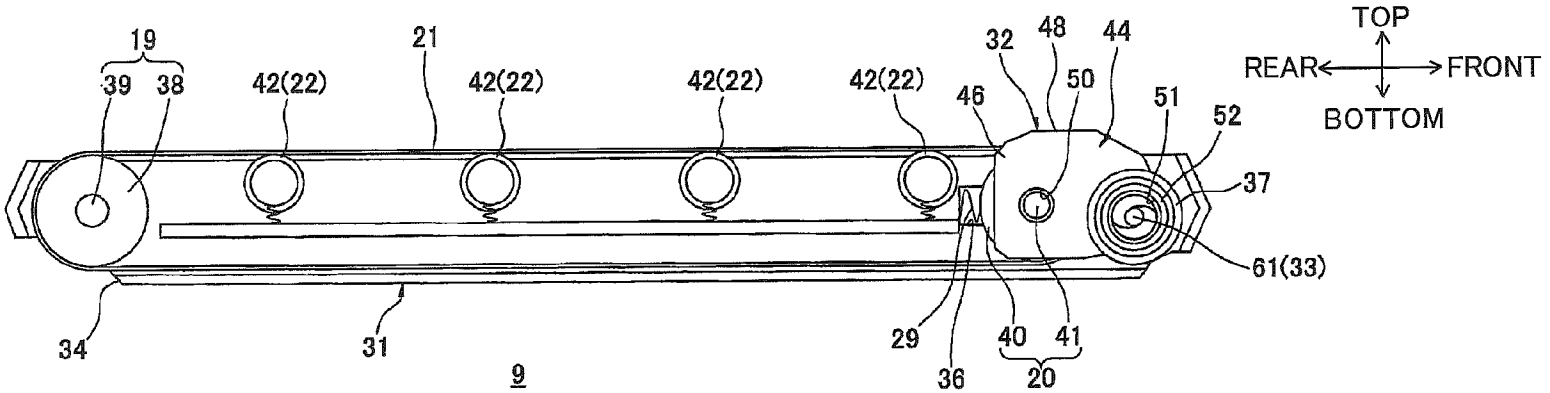

The side walls 46 have a flat plate shape and are generally rectangular in a side view. The side walls 46 are arranged parallel to each other and are spaced apart in the left-right direction, with the gap between side walls 46 in the left-right direction being greater than the left-right length of the follow roller body 40 and shorter than the gap between the left and right side walls of the transfer frame 31. As shown in FIG. 3B, follow-roller-shaft insertion holes 50 are formed one in each of the side walls 46.

The follow-roller-shaft insertion holes 50 are generally circular in a side view and penetrate the side walls 46 near the rear ends thereof. The follow-roller-shaft insertion holes 50 have a diameter that is approximately equivalent to (slightly greater than) the outer diameter of the follow roller shaft 41.

As shown in FIG. 3B, the left side wall 46 is provided with a screw insertion hole 51, and a cleaner-side supported part 52.

The screw insertion hole 51 has a generally circular shape in a side view and is formed near the front end of the side wall 46. The screw insertion hole 51 has a diameter that is slightly larger than the major diameter of a first screw 61 (described later) constituting the first conveying unit 33.

The cleaner-side supported part 52 is generally cylindrical in shape and extends leftward from the peripheral edge portion of the screw insertion hole 51. The cleaner-side supported part 52 has a smaller outer diameter than the inner diameter of the support part 37 constituting the transfer frame 31. The cleaner-side supported part 52 includes a cleaner-side sealing member 53 (see FIG. 5).

The cleaner-side sealing member 53 is affixed to the outer peripheral surface of the cleaner-side supported part 52 so as to cover the entire outer peripheral surface thereof. The cleaner-side sealing member 53 is formed of an elastic material, such as a sponge or nonwoven cloth.

The main body 47 bridges the front ends of the side walls 46. The main body 47 has a general columnar shape elongated in the left-right direction, with a generally D-shaped cross section curved on the front side thereof. A recovery chamber 49 is formed inside the main body 47.

The recovery chamber 49 is a recessed groove formed in the rear side of the main body 47 and is elongated in the left-right direction. A cross section of the recovery chamber 49 is generally U-shaped and open on the rear side. The recovery chamber 49 spans across the entire left-right dimension of the main body 47.

The top wall 48 has a generally flat plate shape that extends rearward from the top edge of the main body 47. The rear edge of the top wall 48 extends to a position farther rearward than the follow roller shaft 41 and forward of the forwardmost transfer roller 22 in a vertical projection.

The cleaning blade 45 is provided on the rear edge constituting the top portion of the main body 47. The cleaning blade 45 is generally plate-shaped and elongated in the left-right direction with substantial thickness in the front-rear direction. The upper half of the cleaning blade 45 is fixed to the portion of the main body 47 forming the top peripheral edge of the recovery chamber 49. The lower half of the cleaning blade 45 confronts the upper half of the recovery chamber 49.

The belt cleaner 32 is coupled to the follow roller 20 by inserting both left and right ends of the follow roller shaft 41 into the follow-roller-shaft insertion holes 50 formed in the side walls 46.

The bottom edge of the cleaning blade 45 confronts the front side of the follow roller 20 with the endless conveying belt 21 interposed therebetween and, hence, contacts the front side of the endless conveying belt 21 looped around the follow roller 20.

As shown in FIGS. 2 and 5, the belt cleaner 32 is supported in the transfer frame 31 by fitting the cleaner-side supported part 52 into the support part 37 formed in the transfer frame 31 from the right side thereof. Hence, both the cleaner-side supported part 52 and the support part 37 are disposed on the left side (left axial end) of the follow roller 20.

At this time, the cleaner-side sealing member 53 contacts the right end portion of the support-part-side sealing member 30 in the transfer frame 31 (see the enlarged view in FIG. 5). The cleaner-side sealing member 53 constitutes an elastic member together with the support-part-side sealing member 30. The cleaner-side sealing member 53 can also be compressed in its thickness direction (i.e., the radial direction of the cleaner-side supported part 52).

With this construction, the belt cleaner 32 is coupled to the transfer frame 31 so that the belt cleaner can move relative to the transfer frame 31 in the front-rear direction a distance equivalent to the compressible amount of the cleaner-side sealing member 53.

(3) First Conveying Unit

As shown in FIGS. 4 and 5, the first conveying unit 33 includes a lift 62, and a first screw 61.

The lift 62 is rotatably supported in the support part 37 of the transfer frame 31. The lift 62 includes a lift-side supported part 63, and an intermediary conveying part 64. In the following description of the lift 62, it will be assumed that the lift 62 is disposed in a coupled position described later (see FIG. 4A).

The lift-side supported part 63 is generally cylindrical in shape, with a closed left end, and is elongated in the left-right direction. The outer diameter of the lift-side supported part 63 is smaller than the inner diameter of the support part 37 constituting the transfer frame 31 and larger than the outer diameter of the cleaner-side supported part 52. The lift-side supported part 63 includes a lift-side sealing member 65.

The lift-side sealing member 65 is affixed to the outer peripheral surface of the lift-side supported part 63 on the right end thereof and covers the entire peripheral surface of this right end portion. The lift-side sealing member 65 is formed of an elastic material such as a sponge or nonwoven cloth.

At the left end of the lift-side supported part 63, the intermediary conveying part 64 is formed continuously with the top of the lift-side supported part 63 (one radial side of the lift-side supported part 63). The intermediary conveying part 64 is shaped like a hollow cylinder elongated in the left-right direction. The intermediary conveying part 64 has a larger diameter than the lift-side supported part 63. A coupling recess 70 is formed in the rear side of the intermediary conveying part 64. A rotary member 66 is disposed inside the intermediary conveying part 64.

The coupling recess 70 has a square U-shape in a side view that is open on the rear side. The coupling recess 70 is provided with a through-hole 71, and a first shutter 72.

The through-hole 71 is generally rectangular in a plan view and elongated in the left-right direction. The through-hole 71 penetrates the top wall of the coupling recess 70, providing communication between the interior and exterior of the intermediary conveying part 64.

The first shutter 72 has a flat plate shape that is generally rectangular in a front view and elongated in the left-right direction. The first shutter 72 is capable of sliding in the left-right direction between a closed position indicated by the dashed line in FIG. 5 for closing the through-hole 71, and an open position to the right of the closed position indicated by the solid line in FIG. 5 for opening the through-hole 71.

The rotary member 66 includes a rotational shaft 67, a rotary member drive gear 69, and a film member 68.

The rotational shaft 67 has a general columnar shape, with its axis aligned with the central axis of the intermediary conveying part 64. The right end of the rotational shaft 67 is rotatably supported in the right wall of the intermediary conveying part 64. The left end of the rotational shaft 67 is rotatably supported in the left wall of the intermediary conveying part 64 and penetrates the left wall to the left side thereof.

The rotary member drive gear 69 is nonrotatably supported on the left end of the rotational shaft 67 on the left side of the left wall constituting the intermediary conveying part 64.

The film member 68 is provided inside the intermediary conveying part 64, extending radially outward from the outer peripheral surface of the rotational shaft 67. The film member 68 is formed of a flexible film that is flat and generally rectangular in shape.

The lift 62 is supported on the transfer frame 31 by inserting the lift-side supported part 63 into the support part 37 of the transfer frame 31 from the left side thereof. Hence, both the lift-side supported part 63 and the support part 37 are disposed on the left side (the left axial end) of the follow roller 20.

At this time, a slight gap is formed between the right side of the lift-side supported part 63 and the opposing left side of the cleaner-side supported part 52. Further, the lift-side sealing member 65 is in contact with the support-part-side sealing member 30 to the left of the cleaner-side sealing member 53. The lift-side sealing member 65 is almost completely compressed in its thickness direction (i.e., the radial direction of the cleaner-side supported part 52) at this time so that it would be nearly impossible to compress the lift-side sealing member 65 further.

Hence, the lift 62 is capable of rotating relative to the transfer frame 31, but is incapable of moving in a radial direction relative to the transfer frame 31.

With this construction, the lift 62 is coupled to the transfer frame 31 while being restricted from moving relative to the transfer frame 31 in the front-rear direction.

The lift 62 can rotate about the central axis of the lift-side supported part 63 between a coupled position (see FIG. 4A) in which the intermediary conveying part 64 is positioned above the lift-side supported part 63, and an uncoupled position (see FIG. 4B) in which the intermediary conveying part 64 is positioned forward of the lift-side supported part 63.

The first screw 61 is a right-handed auger screw formed of a flexible resin or the like. The first screw 61 extends in the left-right direction along the central axis of the lift-side supported part 63 and is inserted through both the lift-side supported part 63 and the recovery chamber 49 of the belt cleaner 32. The right end portion of the rotational shaft constituting the first screw 61 is rotatably supported in the right side wall 46 of the belt cleaner 32, and the left end of the rotational shaft penetrates the left wall of the lift-side supported part 63 and is rotatably supported therein.

The first screw 61 also includes a screw drive gear 73, and a film member 74.

The screw drive gear 73 is nonrotatably supported on the left end portion of the rotational shaft constituting the first screw 61 on the left side of the left wall constituting the lift-side supported part 63. The screw drive gear 73 is engaged with the rotary member drive gear 69.

The film member 74 is disposed inside the lift-side supported part 63 and extends radially outward from the outer peripheral surface of the rotational shaft constituting the first screw 61. The film member 74 is formed of a flexible film that is flat and generally rectangular in shape.

3. Detailed Structure of the Process Unit (1) Process Frame

Figure 6A:
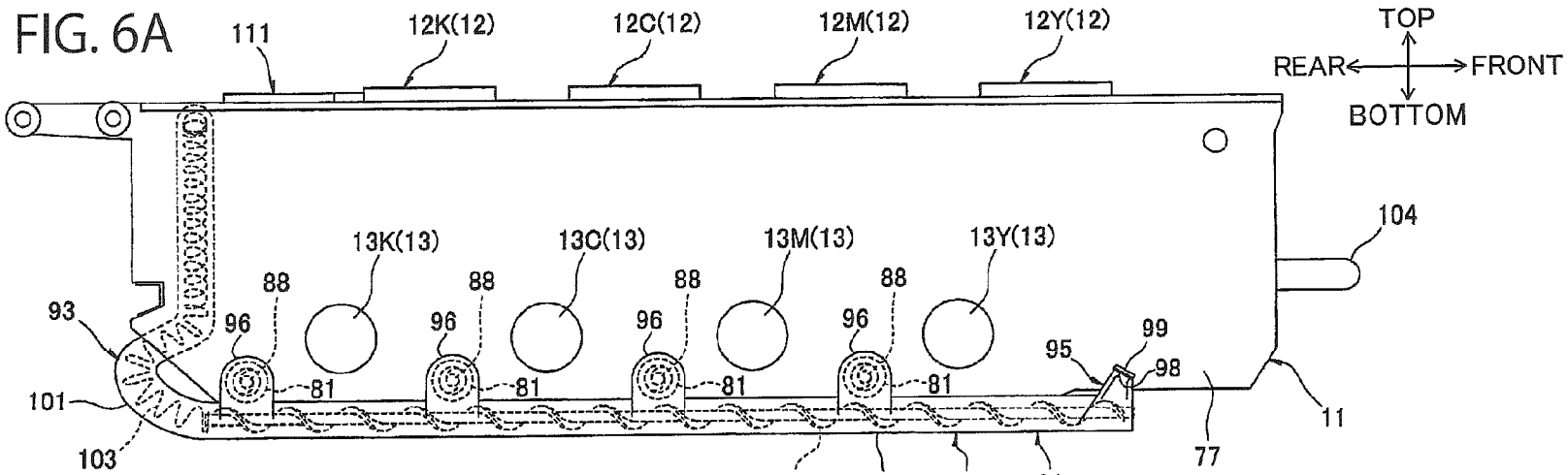
FIG. 6A is a side view of a process unit shown in FIG. 1.
Figure 6B:
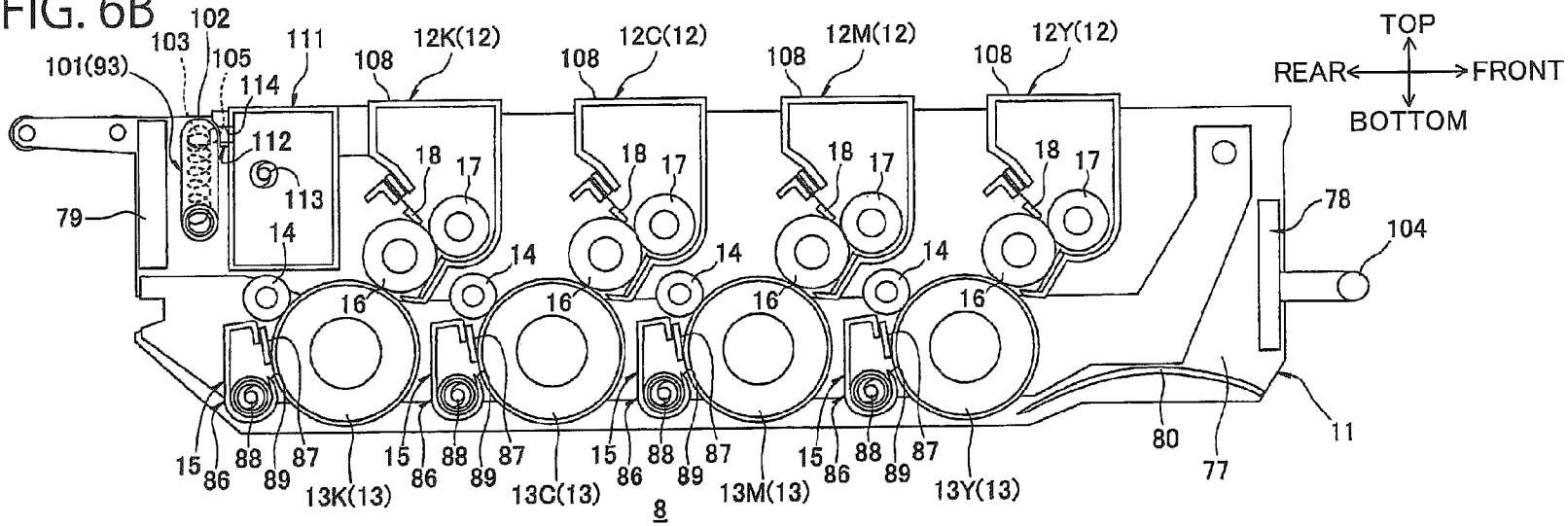
FIG. 6B is a vertical cross-sectional view of the process unit shown in FIG. 1.
Figure 7:
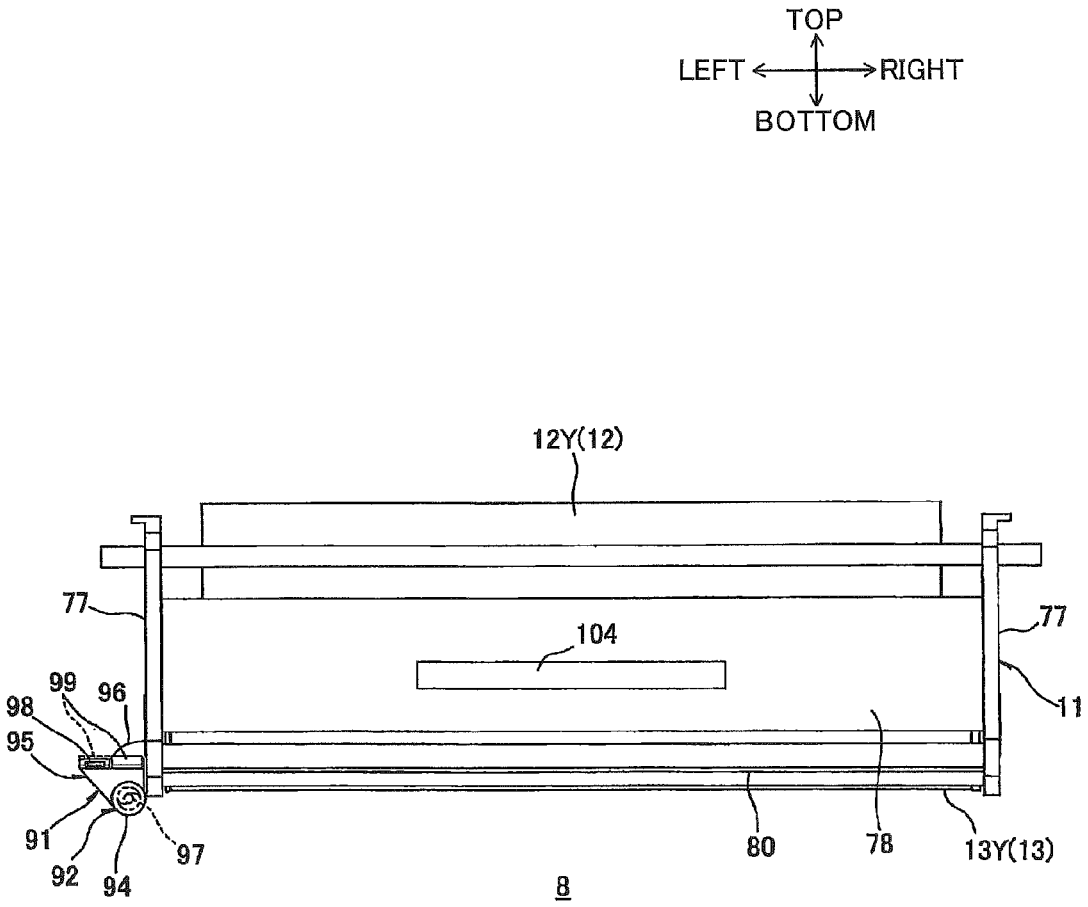
FIG. 7 is a front view of the process unit shown in FIG. 1.

The process frame 11 has a frame-like structure that is generally rectangular in a plan view. As shown in FIGS. 6 and 7, the process frame 11 includes a pair of side walls 77, a front beam 78, a rear beam 79, and a paper guide 80.

The side walls 77 are generally rectangular in a side view and elongated in the front-rear direction. The side walls 77 are arranged parallel to each other and are separated in the left-right direction.

Further, the photosensitive drums 13, charging rollers 14, and drum cleaning units 15 described earlier are supported between the side walls 77.

Each of the drum cleaning units 15 includes a drum cleaner frame 86, a drum-cleaning blade 87, and a drum cleaner screw 88.

The drum cleaner frame 86 is disposed on the rear side of the corresponding photosensitive drum 13. The drum cleaner frame 86 has a square cylindrical shape and is elongated in the left-right direction, bridging the side walls 77. An opening 89 is formed in the drum cleaner frame 86.

The opening 89 penetrates the front wall of the drum cleaner frame 86 in approximately the vertical center thereof and spans across the drum cleaner frame 86 in the left-right direction.

The drum-cleaning blade 87 is provided on the front side of the upper portion of the drum cleaner frame 86. The drum-cleaning blade 87 has a general flat plate shape that is elongated in the left-right direction and has substantial thickness in the front-rear direction. The upper half of the drum-cleaning blade 87 is fixed to the portion of the drum cleaner frame 86 constituting the upper peripheral edge of the opening 89. The lower half of the drum-cleaning blade 87 faces the upper half of the opening 89 formed in the drum cleaner frame 86. The bottom edge of the drum-cleaning blade 87 contacts the rear side of the corresponding photosensitive drum 13.

The drum cleaner screw 88 is a right-handed auger screw that is oriented in the left-right direction and is disposed in the bottom end of the corresponding drum cleaner frame 86. The right end portion of the rotational shaft constituting the drum cleaner screw 88 is rotatably supported in the right side wall 77 constituting the process frame 11. The left end of the rotational shaft is inserted through a screw insertion hole 81 (described later) formed in the left side wall 77 of the process frame 11 and is positioned within a drum cleaner connecting part 96 of a second conveying unit 91 described below.

Four screw insertion holes 81 are formed in the left side wall 77.

The screw insertion holes 81 are formed in the lower portion of the left side wall 77 at intervals in the front-rear direction. The positions of the screw insertion holes 81 correspond to the lower ends of the four drum cleaning units 15. The screw insertion holes 81 are generally circular in a side view and have a slightly larger diameter than the outer diameter of the drum cleaner screws 88.

A second conveying unit 91 is also provided on the left side wall 77. The second conveying unit 91 includes a horizontal conveying unit 92, and a curved conveying unit 93.

The horizontal conveying unit 92 further includes a horizontal part 94, a first coupling part 95, four drum cleaner connecting parts 96, and a second screw 97.

The horizontal part 94 is generally cylindrical in shape and extends in the front-rear direction.

The first coupling part 95 is formed continuously from the front end of the horizontal part 94 and protrudes upward therefrom. The first coupling part 95 has a generally square cylindrical shape, with the front-rear dimension growing shorter and the left-right dimension growing longer from bottom to top. The first coupling part 95 is provided with a through-hole 98, and a second shutter 99.

The through-hole 98 is generally rectangular in a front view and elongated in the left-right direction. The through-hole 98 penetrates the top of the first coupling part 95 across the left half thereof so as to provide communication between the interior and exterior of the horizontal part 94.

The second shutter 99 is formed in a flat plate shape that is generally rectangular in a plan view and elongated in the left-right direction. The second shutter 99 can slide in the left-right direction between a closed position (indicated by the dashed line in FIG. 7) for closing the through-hole 98, and an open position (indicated by the solid line in FIG. 7) to the right of the closed position for opening the through-hole 98.

The drum cleaner connecting parts 96 are spaced apart at intervals in the front-rear direction and are positioned to correspond to the drum cleaning units 15. Each drum cleaner connecting part 96 protrudes leftward from the peripheral edge of the corresponding screw insertion hole 81. The drum cleaner connecting part 96 is generally cylindrical in shape and curves downward from right to left. The lower end of the drum cleaner connecting part 96 is in communication with the top end of the horizontal part 94.

The second screw 97 is a right-handed auger screw elongated in the front-rear direction along the central axis of the horizontal part 94. The front end portion of the rotational shaft constituting the second screw 97 is rotatably supported in the front wall of the first coupling part 95.

The curved conveying unit 93 includes a curved section 101, and a third screw 103.

The curved section 101 is formed of a flexible hose or the like that can be curved. The curved section 101 is formed continuously from the rear end portion of the horizontal part 94 and curves while extending toward the upper right between the rear ends of the side walls 77 constituting the process frame 11. A through-hole 105 is formed in the front side of the upper right end of the curved section 101 to provide communication between the interior and exterior of the curved section 101. The upper right end of the curved section 101 constitutes a second coupling part 102.

The third screw 103 is a coil spring-like screw disposed in the curved section 101 and is formed continuously with the rear end of the second screw 97. The third screw 103 extends along the curved section 101 to a point near the second coupling part 102.

The front beam 78 bridges the front edges of the side walls 77. The front beam 78 has a generally flat plate shape that is elongated in the left-right direction. A grip part 104 is provided on the front surface of the front beam 78. The user grips the grip part 104 when mounting the process frame 11 in or removing the process frame 11 from the main casing 2.

The rear beam 79 bridges the rear edges of the side walls 77. The rear beam 79 has a generally flat plate shape that is elongated in the left-right direction.

The paper guide 80 is disposed in the lower front portion of the process frame 11 and is positioned below and forward of the yellow developer cartridge 12Y. The paper guide 80 has a general flat plate shape that extends in the front-rear direction while curving so that its front-rear center portion protrudes upward. The front edge of the paper guide 80 is positioned below the front beam 78 so that the paper guide 80 can receive sheets P conveyed from the paper tray 6. The rear end of the paper guide 80 extends toward the point between the endless conveying belt 21 and the yellow photosensitive drum 13Y.

(2) Developer Cartridges

As shown in FIG. 6, each developer cartridge 12 is provided with a developer frame 108.

The developer frame 108 has a box-like shape that is elongated in the left-right direction. As described above, the developing roller 16, supply roller 17, and thickness-regulating blade 18 are supported in the bottom portion of the developer frame 108, while the upper portion serves to accommodate toner.

The black developer cartridge 12K is further provided with an accommodating section 111.

The accommodating section 111 is integrally provided on the rear side of the developer frame 108 and has a box-like shape that is elongated in the left-right direction. The accommodating section 111 includes an accommodating-section-side intermediary part 112, and an accommodating section screw 113.

The accommodating-section-side intermediary part 112 is provided on the rear side of the accommodating section 111 in the upper right portion thereof. The accommodating-section-side intermediary part 112 has a generally square columnar shape and protrudes rearward from the accommodating section 111. A receiving hole 114 is formed in the accommodating-section-side intermediary part 112.

The receiving hole 114 is generally circular in a front view and penetrates the accommodating-section-side intermediary part 112 in the front-rear direction.

With this construction, the accommodating section 111 and the second conveying unit 91 are coupled so that the receiving hole 114 of the accommodating-section-side intermediary part 112 opposes the through-hole 105 of the second coupling part 102.

The accommodating section screw 113 is provided in the upper rear portion of the accommodating section 111. The accommodating section screw 113 is a right-handed auger screw that is oriented in the left-right direction. Both ends of the rotational shaft constituting the accommodating section screw 113 are rotatably supported in the side walls of the accommodating section 111.

(3) Mounted State of the Process Unit in the Main Casing

FIG. 1 shows the process unit 8 disposed in its internal position. In this state, the process unit 8 is disposed below the scanning unit 7 and above the transfer unit 9, as described above.

At this time, the first shutter 72 of the first conveying unit 33 is disposed in the open position indicated by the solid line in FIG. 5 for exposing the through-hole 71, and the second shutter 99 of the second conveying unit 91 is disposed in the open position indicated by the solid line in FIG. 7 for exposing the through-hole 98.

Figure 8:
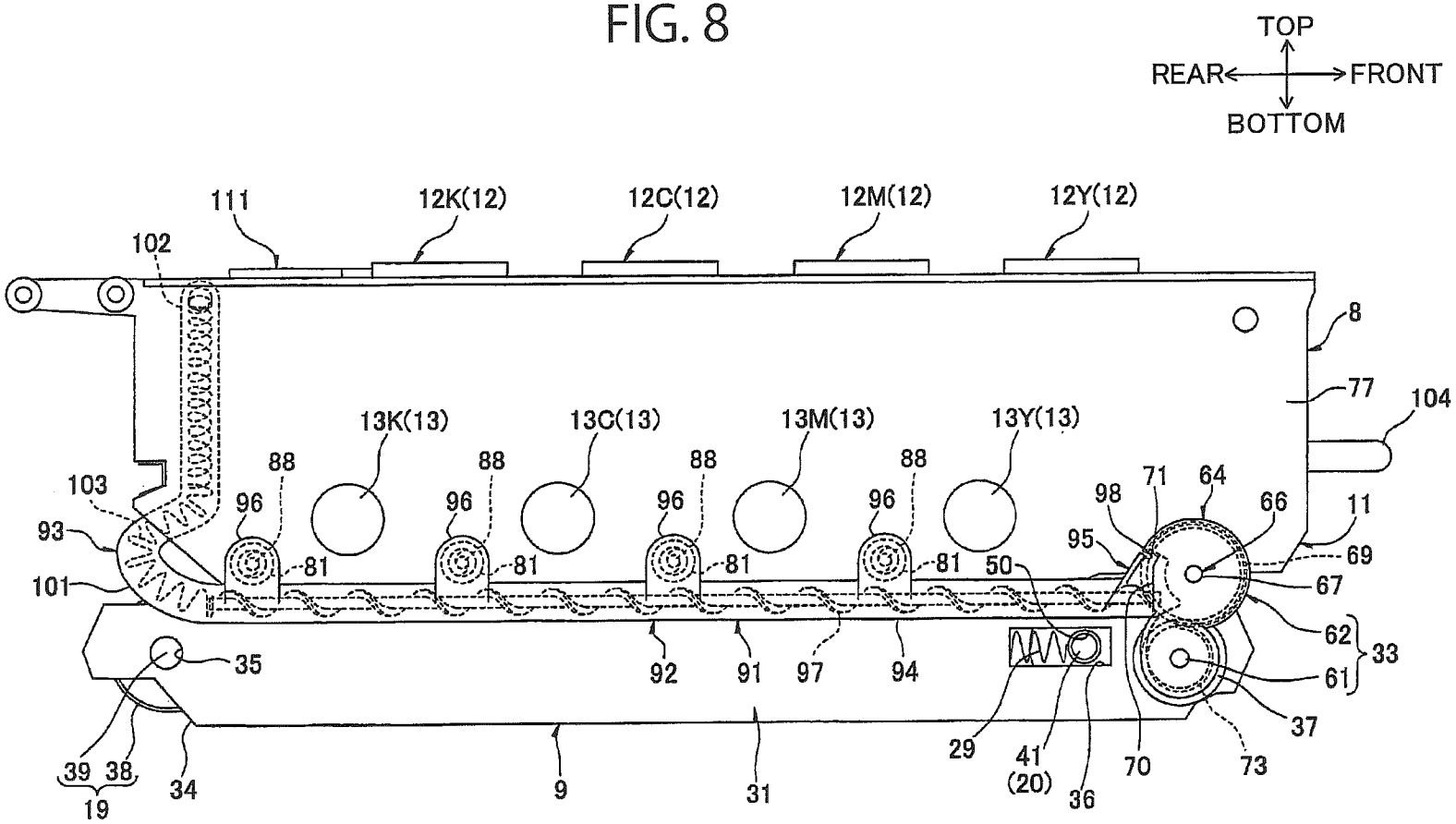
FIG. 8 is an explanatory diagram showing a coupling with the first conveying unit and a second conveying unit.

As shown in FIG. 8, the first conveying unit 33 is disposed in the coupled position (see FIG. 4A) in which the intermediary conveying part 64 is positioned above the lift-side supported part 63. In this position, the coupling recess 70 is coupled with the first coupling part 95 of the second conveying unit 91 from the front side thereof. Consequently, the through-hole 71 in the first conveying unit 33 is in communication with the through-hole 98 of the second conveying unit 91.

4. Operations for Recovering Matter Deposited on the Conveying Belt and Photosensitive Drums Prior to executing the image-forming operation described earlier, the printer 1 directly transfers toner onto the surface of the endless conveying belt 21 to form a printed pattern (patches).

As the endless conveying belt 21 circulates, bringing the printed pattern opposite the patch sensor 27 on the lower side of the transfer unit 9, the patch sensor 27 reads the printed pattern and measures positional offset and image density for each printed color.

As the endless conveying belt 21 continues to circulate, the printed pattern passes through the area in which the cleaning blade 45 contacts the endless conveying belt 21. The cleaning blade 45 scrapes off residual toner, paper dust, and other matter deposited on the endless conveying belt 21 and the matter is collected in the recovery chamber 49 of the cleaner frame 44.

Since the belt cleaner 32 is configured to move in the front-rear direction together with the follow roller 20, the belt cleaner 32 can reliably recover (remove) residual toner and other matter from the endless conveying belt 21.

This completes the operation for measuring the positional offset and image density of each printed color.

Next, as described earlier, the sheet-feeding unit 3 feeds a sheet P toward the image-forming unit 4. The endless conveying belt 21 conveys the sheet P rearward so that the sheet P sequentially passes between each photosensitive drum 13 and opposing transfer roller 22 while an image is formed on the sheet P.

After completing this image-forming operation and prior to executing the next image-forming operation, the printer 1 recovers residual toner and other matter deposited on the photosensitive drums 13.

As shown in FIG. 6, the drum-cleaning blades 87 contacting the rear sides of the corresponding photosensitive drums 13 scrape off residual toner and other matter deposited on the photosensitive drums 13, and the matter is collected in the corresponding drum cleaner frames 86.

Through this process, the printer 1 can remove and collect residual toner and other matter that has become deposited on the endless conveying belt 21 and the photosensitive drums 13.

Next, the first screw 61 in the recovery chamber 49 of the cleaner frame 44 rotates clockwise in a left side view to convey the residual toner and other deposited matter collected in the recovery chamber 49 to the left end of the cleaner frame 44 shown in FIG. 5. The first screw 61 conveys the residual toner through the cleaner-side supported part 52 and support part 37 into the lift-side supported part 63.

Since the first screw 61 is formed of a flexible resin or the like, the first screw 61 is reliably supported in the right side wall 46 of the belt cleaner 32 and the left wall of the lift-side supported part 63, even if the belt cleaner 32 and first conveying unit 33 move in the front-rear direction.

As the first screw 61 rotates, residual toner and other matter conveyed to the lift-side supported part 63 is subsequently pushed out of the lift-side supported part 63 into the intermediary conveying part 64 shown in FIG. 4A.

Next, the rotating rotary member 66 causes the film member 68 to push the residual toner in the intermediary conveying part 64 out of the intermediary conveying part 64 through the through-hole 71 and into the first coupling part 95 through the through-hole 98, thereby conveying the residual toner to the horizontal part 94 of the horizontal conveying unit 92 (see FIG. 8).

At the same time, the drum cleaner screws 88 in the drum cleaner frames 86 rotate clockwise in a left side view to convey residual toner and other deposited matter stored in the drum cleaner frames 86 toward the left ends of the drum cleaner frames 86. As illustrated in FIG. 6, the residual toner and other deposited matter conveyed by the drum cleaner screws 88 pass through the screw insertion holes 81 formed in the left side wall 77 of the process frame 11 and is conveyed to the horizontal part 94 of the horizontal conveying unit 92 via the drum cleaner connecting parts 96.

In this way, residual toner and other deposited matter recovered from the endless conveying belt 21 and photosensitive drums 13 are conveyed to the horizontal part 94 of the horizontal conveying unit 92. Subsequently, the rotating second screw 97 conveys this residual toner through the horizontal part 94 to the curved conveying unit 93.

When deposited matter has been conveyed to the curved conveying unit 93, the rotating third screw 103 conveys this matter through the curved section 101 to a point near the second coupling part 102, and matter accumulated at the second coupling part 102 falls through the second coupling part 102 and accommodating-section-side intermediary part 112 into the accommodating section 111.

In this way, residual toner and other deposited matter collected from the endless conveying belt 21 and photosensitive drums 13 are stored in the accommodating section 111.

5. Operations for Replacing a Developer Cartridge

To replace one of the developer cartridges 12, first the user pulls the process unit 8 out to the external position.

To pull the process unit 8 out to the external position, the user opens the front cover 5 of the main casing 2 by rotating the front cover 5 forward and downward about its bottom edge, as shown in FIG. 9.

Next, the user moves the first shutter 72 of the first conveying unit 33 into the closed position indicated by the dashed line in FIG. 5 for closing the through-hole 71 and moves the second shutter 99 of the second conveying unit 91 into the closed position indicated by the dashed line in FIG. 7 for closing the through-hole 98. These operations interrupt communication between the through-hole 71 of the first conveying unit 33 and the through-hole 98 of the second conveying unit 91.

Figure 4B:
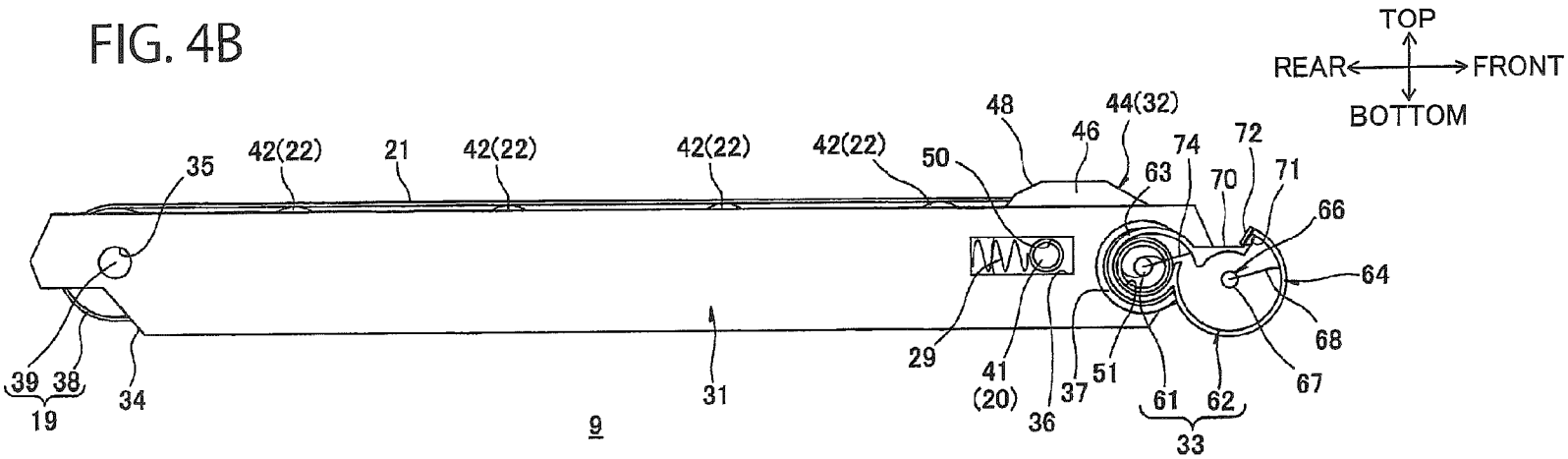

Next, the user rotates the first conveying unit 33 about the central axis of the lift-side supported part 63 into the uncoupled position shown in FIG. 4B. This operation separates the coupling recess 70 from the first coupling part 95.

Next, the user grips the grip part 104 and pulls the process unit 8 forward, thereby separating the photosensitive drums 13 from the endless conveying belt 21 and moving the process unit 8 into the external position.

Next, the user removes the developer cartridge 12 to be replaced from the process unit 8.

To remove from the developer cartridge 12, the user pulls the developer cartridge 12 upward from the process unit 8.

When removing the black developer cartridge 12K, the receiving hole 114 moves upward relative to the through-hole 105, separating the accommodating-section-side intermediary part 112 of the accommodating section 111 from the second coupling part 102 of the second conveying unit 91.

Through this operation, the accommodating section 111 provided integrally with the black developer cartridge 12K is separated from the process unit 8, enabling the user to perform maintenance on the accommodating section 111.

To mount a developer cartridge 12 into the process unit 8, the user performs the operation described above in reverse.

Specifically, the user positions the developer cartridge 12 above the process unit 8 and pushes the developer cartridge 12 into the process unit 8.

When mounting a black developer cartridge 12K into the process unit 8, the receiving hole 114 moves to a position opposite the through-hole 105, allowing for communication between the second coupling part 102 of the second conveying unit 91 and the accommodating-section-side intermediary part 112 of the accommodating section 111.

Next, the user grips the grip part 104 and pushes the process unit 8 rearward into the main casing 2.

Subsequently, the user rotates the first conveying unit 33 about the central axis of the lift-side supported part 63 into the coupled position shown in FIG. 4A. Through this operation, the coupling recess 70 is coupled with the first coupling part 95.

Next, the user moves the first shutter 72 of the first conveying unit 33 into the open position indicated by the solid line in FIG. 5 for exposing the through-hole 71 and moves the second shutter 99 of the second conveying unit 91 into the open position indicated by the solid line in FIG. 7 for exposing the through-hole 98. Through these operations, the through-hole 71 of the first conveying unit 33 is in communication with the through-hole 98 of the second conveying unit 91.

Thereafter, the user closes the front cover 5 of the main casing 2, thereby completing the operation for replacing a developer cartridge 12.

6. Operational Advantages (1) As shown in FIG. 5, the support part 37 of the transfer frame 31 is coupled to the cleaner-side supported part 52 of the belt cleaner 32 through elastic members (the support-part-side sealing member 30 and cleaner-side sealing member 53), allowing for relative movement in the front-rear direction.

With this construction, residual toner, paper dust, and other deposited matter that the cleaning blade 45 has recovered (removed) from the endless conveying belt 21 is less likely to leak out through the region in which the support part 37 is coupled to the cleaner-side supported part 52, even when the belt cleaner 32 moves in response to movement of the follow roller 20.

The support part 37 of the transfer frame 31 is also coupled to the lift-side supported part 63 of the first conveying unit 33 in a manner that restricts relative movement in the front-rear direction.

This construction ensures that deposited matter, such as residual toner and paper dust removed from the endless conveying belt 21 by the cleaning blade 45, can be conveyed into the lift-side supported part 63 without this deposited matter leaking out through the coupled region between the support part 37 and lift-side supported part 63.

Subsequently, deposited matter conveyed into the lift-side supported part 63 can be conveyed to the accommodating section 111 via the second conveying unit 91 and stored in the accommodating section 111.

Thus, through a simple construction, the printer 1 according to the first embodiment can recover matter deposited on the endless conveying belt 21 of the transfer unit 9, including residual toner and paper dust, and convey this matter to the accommodating section 111 of the process unit 8. Further, maintenance of the accommodating section 111 is simplified since the accommodating section 111 can be replaced together with the black developer cartridge 12K.

(2) As shown in FIG. 5, the support part 37 and cleaner-side supported part 52 can be coupled by inserting the cleaner-side supported part 52 into the support part 37 so that the members partially overlap through the support-part-side sealing member 30.

Accordingly, through a simple construction, the printer 1 according to the first embodiment can reduce the chance that deposited matter, such as residual toner and paper dust removed by the cleaning blade 45, will leak through the coupled region between the support part 37 and cleaner-side supported part 52.

(3) As shown in FIG. 5, the support part 37 and cleaner-side supported part 52 are coupled to each other through members formed of elastic material, such as a sponge or nonwoven cloth.

Hence, the elasticity of such materials can be used to allow relative movement between the cleaner-side supported part 52 and support part 37.

(4) As shown in FIG. 5, the elastic members used in the printer 1 include the support-part-side sealing member 30 provided on the support part 37 side, and the cleaner-side sealing member 53 provided on the cleaner-side supported part 52 side that contacts the support-part-side sealing member 30.

This construction suppresses the leakage of deposited matter removed by the cleaning blade 45 through the region of contact between the support part 37 and cleaner-side supported part 52.

This construction also facilitates the operations for assembling the belt cleaner 32 on the transfer frame 31. For example, first the support-part-side sealing member 30 is provided on the support part 37 side; then the cleaner-side sealing member 53 is provided on the cleaner-side supported part 52 side, and finally the two members are assembled together.

(5) As shown in FIG. 5, the first screw 61 of the printer 1 can efficiently convey residual toner, paper dust, and other deposited matter removed by the cleaning blade 45 so that the deposited matter accumulates on the left side of the cleaner frame 44.

(6) As shown in FIG. 5, the left end of the first screw 61 protrudes into the lift-side supported part 63, ensuring that the first screw 61 can reliably convey deposited matter removed by the cleaning blade 45 to the first conveying unit 33.

(7) In the printer 1 according to the first embodiment, the first screw 61 is flexible, enabling the first screw 61 to follow the movement of the belt cleaner 32 while the belt cleaner 32 moves relative to the first conveying unit 33.

This configuration can convey deposited matter removed by the cleaning blade 45 to the first conveying unit 33 more reliably.

(8) As shown in FIG. 4, the belt cleaner 32 is coupled to the transfer frame 31 in a manner that allows the belt cleaner 32 to move relative to the transfer frame 31 in the front-rear direction. The first conveying unit 33 is coupled to the transfer frame 31 so as to be capable of rotating relative to the transfer frame 31 about the center of the lift-side supported part 63.

Accordingly, the first conveying unit 33 can be rotated even when the belt cleaner 32 moves in response to movement by the follow roller 20.

Thus, this construction suppresses leakage of residual toner and other deposited matter removed by the cleaning blade 45 through the coupled region of the lift-side supported part 63 and support part 37.

7. Variations of the First Embodiment

In the first embodiment described above, the belt cleaner 32 is supported on the transfer frame 31 by inserting the cleaner-side supported part 52 into the support part 37. However, the belt cleaner 32 may be supported on the transfer frame 31 by inserting the support part 37 into the cleaner-side supported part 52 instead.

In this case, the support-part-side sealing member 30 must be affixed to the outer peripheral surface of the support part 37 so as to cover the entire outer peripheral surface thereof, and the cleaner-side sealing member 53 must be affixed to the inner peripheral surface of the cleaner-side supported part 52 so as to cover the entire inner peripheral surface thereof. This variation of the first embodiment can obtain the same operational advantages described in the first embodiment.

<Second Embodiment>

1. Overall Structure of a Printer

Figure 10:
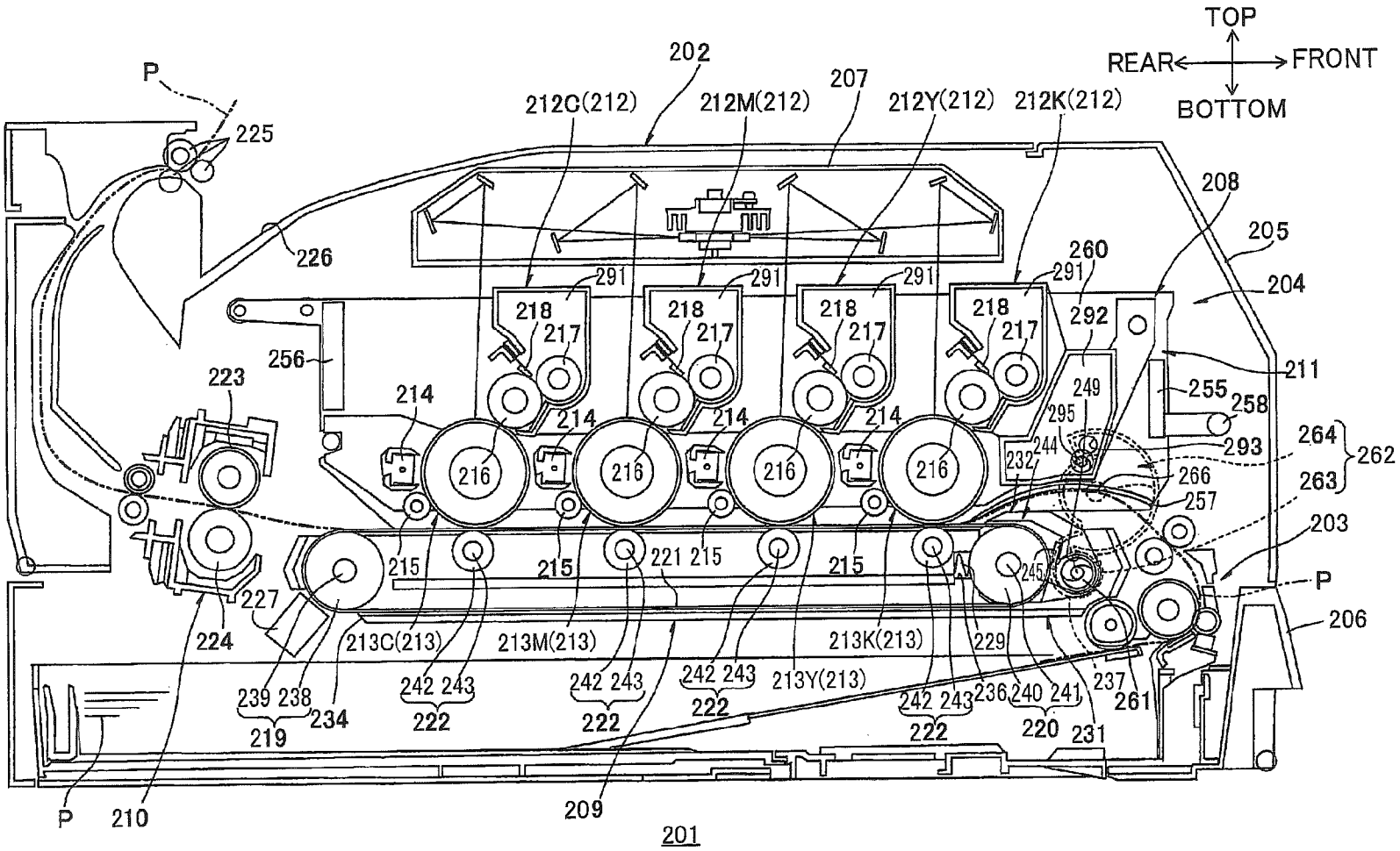
FIG. 10 is a vertical cross-sectional view of an image-forming device according to a second embodiment of the present invention.

FIG. 10 shows a printer 201 serving as an example of the image-forming device according to the present invention. The printer 201 is a direct horizontal tandem-type color laser printer. The printer 201 includes a main casing 202 constituting the device body.

The main casing 202 is formed in a box-like shape that is generally rectangular in a side view. A front cover 205 is provided on one side of the main casing 202 for mounting and removing a process unit 208 described later.

Descriptions used in the following description in relation to the printer 201 will reference the state of the printer 201 when the printer 201 is resting on a flat surface. More specifically, the side of the printer 201 on which the front cover 205 is provided (the right side in FIG. 10) will be referred to as the "front side," and the opposite side (the left side in FIG. 10) as the "rear side," as indicated by the arrows in FIG. 10. Further, left and right sides of the printer 201 in the following description will be based on the perspective of the user facing the front side of the printer 201. Thus, the near side of the printer 201 in FIG. 10 will be considered the "left side," and the far side will be considered the "right side."

Within the main casing 202, the printer 201 also includes a sheet-feeding unit 203 for feeding sheets P of paper to be printed, and an image-forming unit 204 for forming images on the sheets P supplied by the sheet-feeding unit 203.

(1) Sheet-Feeding Unit

The sheet-feeding unit 203 is disposed in the bottom section of the main casing 202 and includes a paper tray 206 accommodating sheets P of paper, and a plurality of rollers for conveying the sheets P to the image-forming unit 204.

(2) Image-Forming Unit

The image-forming unit 204 includes a scanning unit 207, a process unit 208, a transfer unit 209, and a fixing unit 210.

(2-1) Scanning Unit

The scanning unit 207 is disposed in the top section of the main casing 202. The scanning unit 207 emits four laser beams toward respective photosensitive drums 213 (described later), the paths of which are depicted by solid lines in FIG. 10, thereby exposing the photosensitive drums 213.

(2-2) Process Unit

The process unit 208 is disposed beneath the scanning unit 207 and above the transfer unit 209. The process unit 208 includes four developer cartridges 212 corresponding to the four colors used in image formation, and a process frame 211 for retaining the developer cartridges 212.

Figure 19:
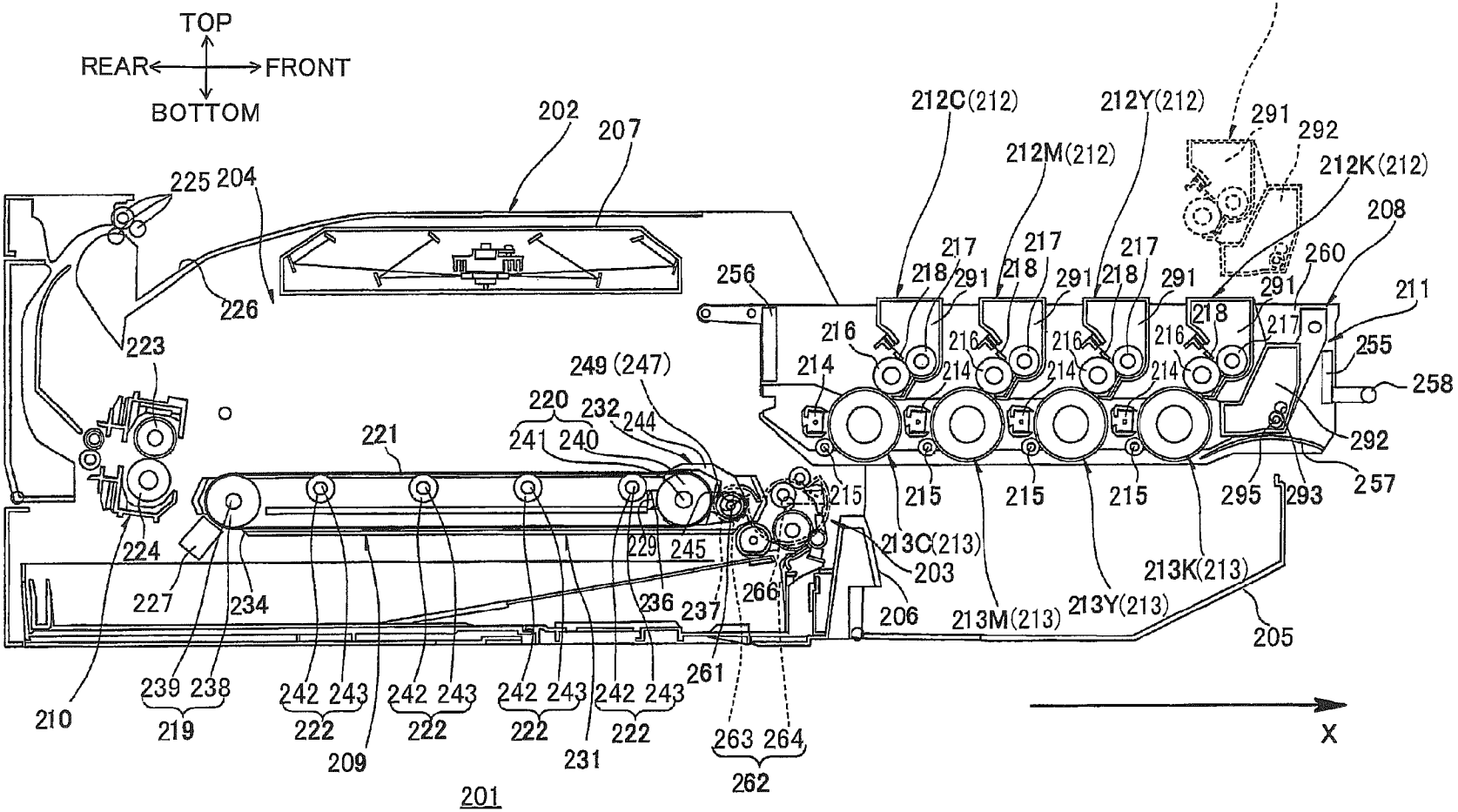
FIG. 19 is an explanatory diagram showing a state a process unit shown in FIG. 10 is disposed in an external position.

The process frame 211 can move relative to the main casing 202 in the front-rear direction (parallel direction) between an internal position (see FIG. 10) and an external position (see FIG. 19). In the internal position, the process frame 211 is accommodated inside the main casing 2. In the external position, the process frame 211 is withdrawn to the outside of the main casing 202.

The process frame 211 retains four each of photosensitive drums 213, scorotron chargers 214, and drum cleaning rollers 215.

The four photosensitive drums 213 corresponding to the four printing colors are arranged parallel to one another and are spaced at intervals in the front-rear direction. Specifically, the photosensitive drums 213 include a black photosensitive drum 213K, a yellow photosensitive drum 213Y, a magenta photosensitive drum 213M, and a cyan photosensitive drum 213C arranged in the order given from the front side to the rear side. In other words, the black photosensitive drum 213K is positioned farthest to the downstream side with respect to the direction that the process frame 211 moves from the internal position to the external position (hereinafter referred to as the withdrawal direction X).

The photosensitive drums 213 are generally cylindrical in shape and are oriented with their axes aligned in the left-right direction (longitudinal direction).

The scorotron chargers 214 are disposed on the rear side of corresponding photosensitive drums 213 and confront the photosensitive drums from a distance.

The drum cleaning rollers 215 are disposed beneath the corresponding scorotron chargers 214 and to the lower rear side of the corresponding photosensitive drums 213. The drum cleaning rollers 215 contact the photosensitive drums 213 from the lower rear side thereof and function to clean the surfaces of the photosensitive drums 213, as will be described later in greater detail.

The developer cartridges 212 are provided to correspond with the four photosensitive drums 213 and are arranged parallel to one another and spaced apart at intervals in the front-rear direction. Specifically, the developer cartridges 212 include a black developer cartridge 212K, a yellow developer cartridge 212Y, a magenta developer cartridge 212M, and a cyan developer cartridge 212C arranged in the order given from front to rear. In other words, the black developer cartridge 212K is disposed farthest downstream in the withdrawal direction X.

The developer cartridges 212 are formed in a box-like shape elongated in the left-right direction and are detachably mounted in the process frame 211 so as to be positioned on the upper front side of the corresponding photosensitive drums 213.

Each developer cartridge 212 includes a developing roller 216.

The developing roller 216 is rotatably supported in the lower portion of the developer cartridge 212. The developing roller 216 is exposed in the rear side of the developer cartridge 212 and contacts the upper front side of the corresponding photosensitive drum 213.

Each developer cartridge 212 also includes a supply roller 217 that contacts the upper front side of the corresponding developing roller 216, and a thickness-regulating blade 218 that contacts the top of the corresponding developing roller 216. Each developer cartridge 212 has space formed above the supply roller 217 and thickness-regulating blade 218 for accommodating toner.

(2-3) Transfer Unit

The transfer unit 209 is disposed in the main casing 202 at a position above the sheet-feeding unit 203 and beneath the process unit 208. The transfer unit 209 includes a drive roller 219, a follow roller 220, an endless conveying belt 221, and four transfer rollers 222.

The drive roller 219 and follow roller 220 are arranged parallel to each other and are separated in the front-rear direction.

The endless conveying belt 221 is looped around the drive roller 219 and follow roller 220, with the upper portion of the endless conveying belt 221 in contact with the bottom sides of the photosensitive drums 213. Thus, the drive roller 219 and follow roller 220 are in contact with the inner surface of the endless conveying belt 221. Hence, when the drive roller 219 is driven to rotate, the endless conveying belt 221 circulates counterclockwise in a left side view so that its upper portion moves rearward, and the follow roller 220 rotates along with the circulating endless conveying belt 221.

Each of the transfer rollers 222 is disposed in confrontation with a corresponding photosensitive drum 213, with the upper portion of the endless conveying belt 221 interposed between the top of each transfer roller 222 and the bottom of the corresponding photosensitive drum 213.

A patch sensor 227 is also provided in the main casing 202 on the lower rear side of the transfer unit 209.

(2-4) Fixing Unit

The fixing unit 210 is disposed on the rear side of the transfer unit 209. The fixing unit 210 includes a heating roller 223, and a pressure roller 224 that contacts and applies pressure to the bottom side of the heating roller 223.

(3) Image-Forming Operation

Toner in each of the developer cartridges 212 is supplied onto the corresponding supply roller 217, and the supply roller 217 in turn supplies the toner onto the corresponding developing roller 216 while the toner is tribocharged between the supply roller 217 and developing roller 216.

The thickness-regulating blade 218 regulates the thickness of toner supplied to the developing roller 216 as the developing roller 216 rotates, maintaining the toner carried on the surface of the developing roller 216 at a thin uniform thickness.

In the meantime, the scorotron charger 214 applies a uniform charge to the surface of the corresponding photosensitive drum 213. Subsequently, the photosensitive drum 213 is exposed by the scanning unit 207, forming an electrostatic latent image on the surface of the photosensitive drum 213 based on image data.

The toner carried on the developing roller 216 is then supplied to the latent image formed on the photosensitive drum 213 to produce a toner image thereon.

The various rollers constituting the sheet-feeding unit 203 rotate to convey a sheet P from the paper tray 206 along a U-shaped path that changes the conveying direction from a forward direction to a diagonally rearward and upward direction. The rollers supply one sheet P at a time toward the image-forming unit 204 (between the photosensitive drums 213 and the endless conveying belt 221) at a prescribed timing.

The endless conveying belt 221 subsequently conveys the sheet P rearward so that the sheet P passes sequentially between the photosensitive drums 213 and corresponding transfer rollers 222. At this time, toner images carried on the photosensitive drums 213 are transferred to the sheet P to form an image thereon.

Next, the sheet P is subjected to heat and pressure while passing between the heating roller 223 and pressure roller 224 of the fixing unit 210, thereby fixing the image to the sheet P. Subsequently, the sheet P is conveyed along a U-shaped path that changes the conveying direction from a rearward direction to a direction diagonally upward and forward.

Discharge rollers 225 disposed at the top of the conveying path discharge the sheet P onto a discharge tray 226 formed on the top surface of the main casing 202.

2. Detailed Structure of the Transfer Unit

Figure 11:
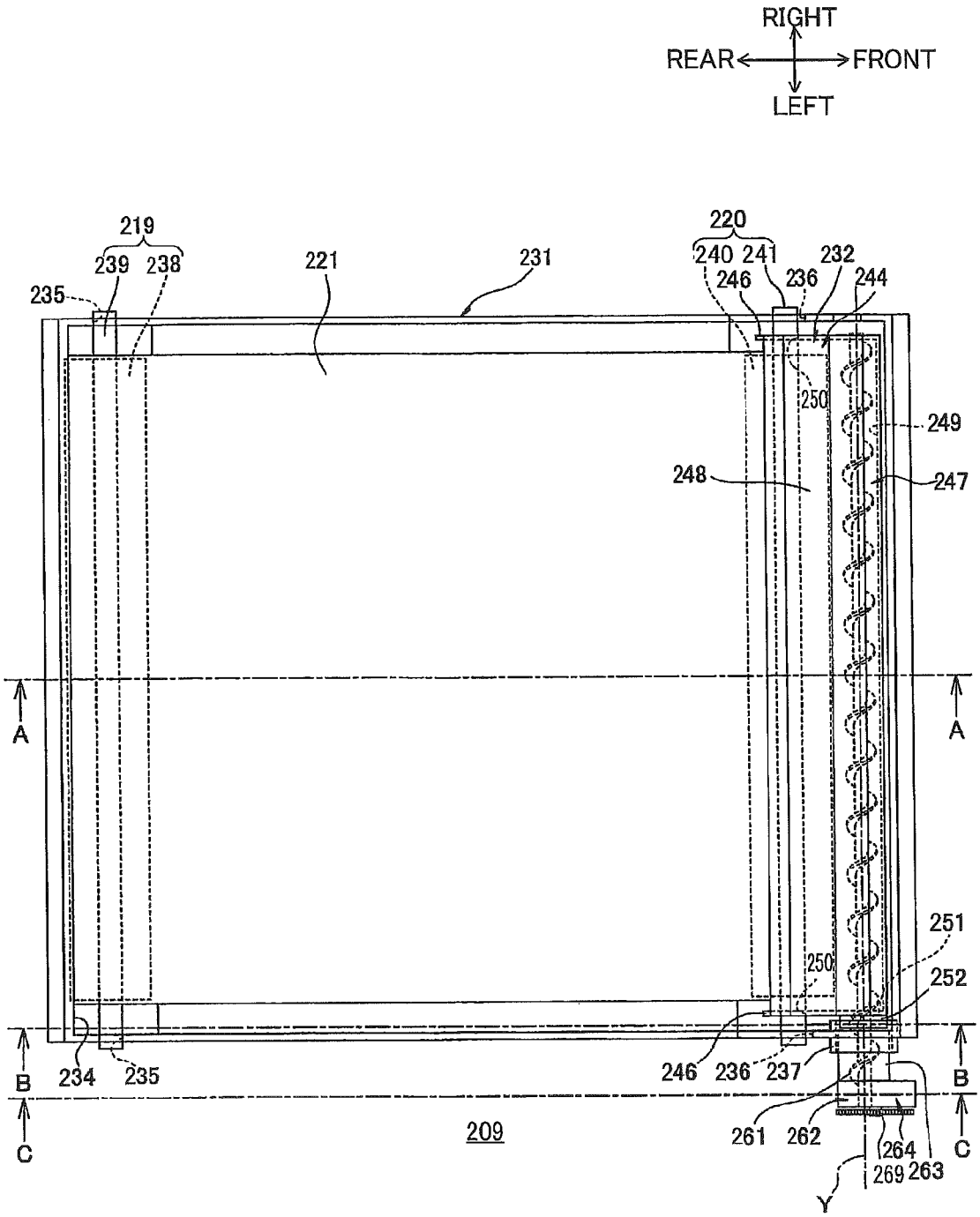
FIG. 11 is a plan view of a transfer unit shown in FIG. 10.

As shown in FIGS. 11 and 12, the transfer unit 209 is provided with a transfer frame 231, a belt cleaner 232, and a first conveying unit 233.

(1) Transfer Frame

As shown in FIGS. 11 and 13, the transfer frame 231 has a frame-like structure with a closed bottom and is generally rectangular in a plan view. The transfer frame 231 includes an exposure opening 234, drive-roller-shaft insertion holes 235, follow-roller-shaft insertion openings 236, and a support part 237.

The exposure opening 234 is formed in the bottom portion of the transfer frame 231 at the rear end thereof and extends across the entire left-right dimension of the transfer frame 231. The exposure opening 234 is formed in an area confronting the patch sensor 227 provided in the main casing 202 (see FIG. 10).

The drive-roller-shaft insertion holes 235 are generally circular in a side view and formed in the rear end of the transfer frame 231, with one drive-roller-shaft insertion hole 235 penetrating each of the left and right side walls thereof. The drive-roller-shaft insertion holes 235 have a diameter approximately equivalent to (slightly larger than) the major diameter of a drive roller shaft 239 described later.

The follow-roller-shaft insertion openings 236 have a general rectangular shape in a side view that is elongated in the front-rear direction, and penetrate the left and right side walls of the transfer frame 231 near the front ends thereof. The follow-roller-shaft insertion openings 236 have a vertical dimension that is approximately equivalent to (slightly larger than) the major diameter of a follow roller shaft 241 described later.

A compression spring 229 is provided inside each of the follow-roller-shaft insertion openings 236. The compression spring 229 is a compression coil spring that extends in the front-rear direction. The rear end of the compression spring 229 is anchored to the inner surface on the rear side of the corresponding follow-roller-shaft insertion opening 236.

The support part 237 is provided on the left wall of the transfer frame 231 near the front end thereof and is positioned forward of the follow-roller-shaft insertion opening 236. The support part 237 is generally cylindrical in shape and elongated in the left-right direction so as to penetrate the left wall of the transfer frame 231. The support part is provided with a support-part-side sealing member 230 (see FIG. 14).

Figure 14:
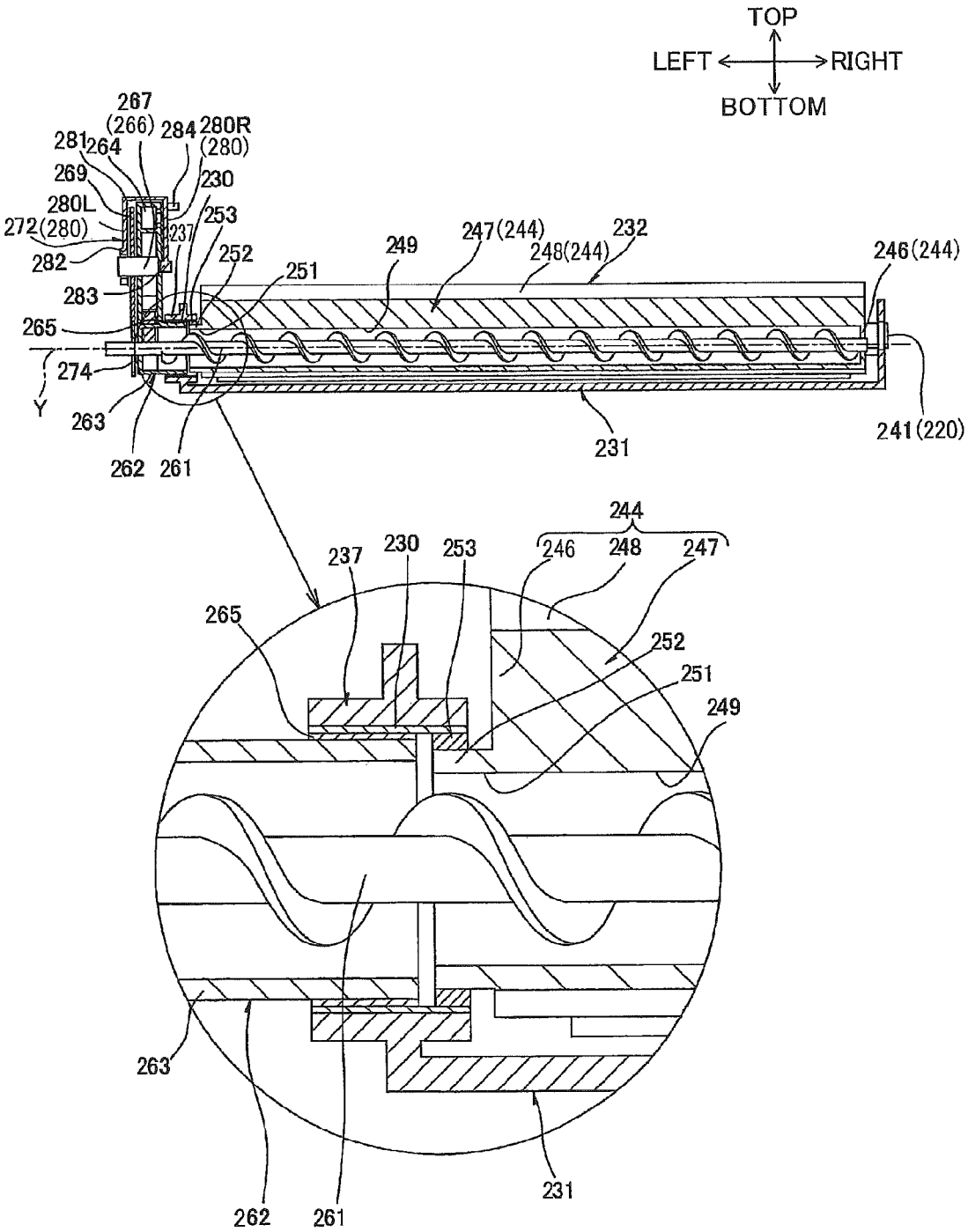
FIG. 14 is a cross-sectional view of the transfer unit along a D-D line in FIG. 13A.

As shown in FIG. 14, the support-part-side sealing member 230 is affixed to the inner peripheral surface of the support part 237 so as to cover the entire inner peripheral surface thereof. The support-part-side sealing member 230 is formed of an elastic material such as a sponge or nonwoven fabric.

As shown in FIGS. 11 and 12, the transfer frame 231 supports the drive roller 219, the follow roller 220, the four transfer rollers 222, and the endless conveying belt 221.

The drive roller 219 includes a drive roller body 238, and a drive roller shaft 239.

The drive roller body 238 has a generally cylindrical shape that is elongated in the left-right direction and is retained in the transfer frame 231 so that its top peripheral portion is positioned above the top of the transfer frame 231. The lower rear peripheral portion of the drive roller body 238 is exposed in the lower rear portion of the transfer frame 231 through the exposure opening 234. The left-right length of the drive roller body 238 is slightly shorter than the left-right dimension of the endless conveying belt 221.

The drive roller shaft 239 is inserted through the drive roller body 238 such that the left and right ends of the drive roller shaft 239 are exposed on the outside of the drive roller body 238. The drive roller shaft 239 is generally rod-shaped, with its longitudinal dimension aligned with the central axis of the drive roller body 238. The left-right length of the drive roller shaft 239 is greater than the left-right dimension of the endless conveying belt 221. Both left and right ends of the drive roller shaft 239 are fixed to the drive roller body 238 by flange members (not shown) so that the drive roller shaft 239 cannot rotate relative to the drive roller body 238.

Figure 13A:
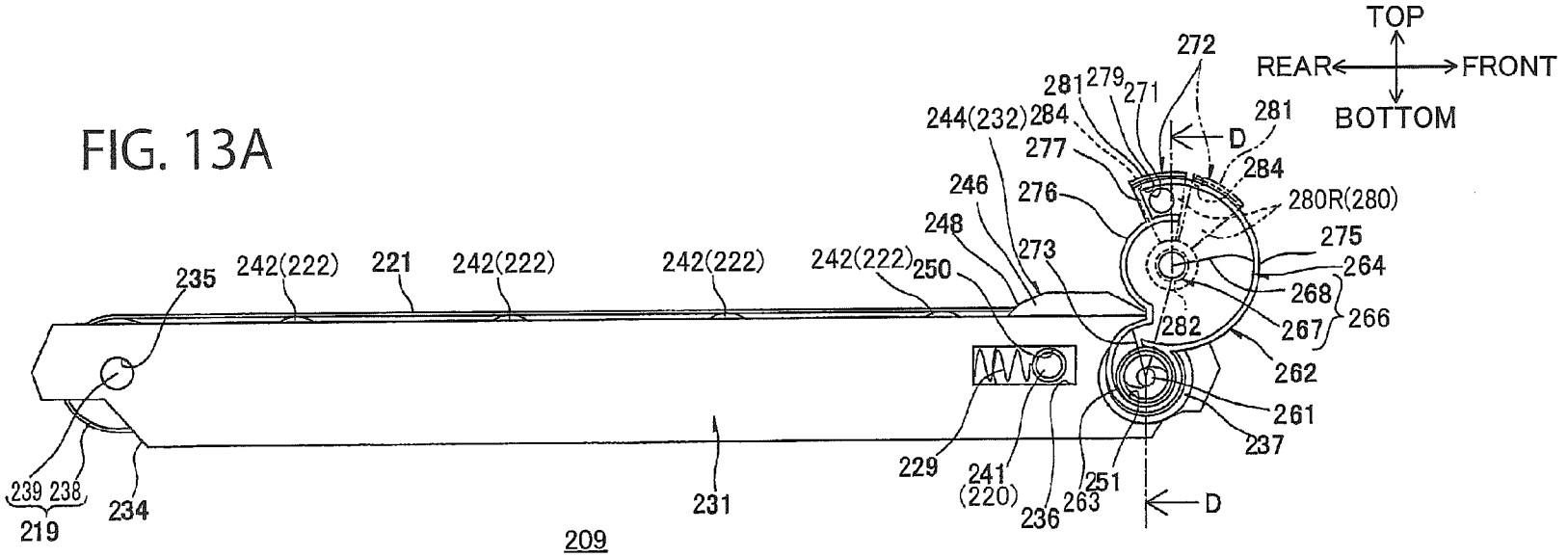

The left and right ends of the drive roller shaft 239 are rotatably inserted into the corresponding drive-roller-shaft insertion holes 235 formed in the left and right sides of the transfer frame 231 (see FIG. 13A).

The follow roller 220 includes a follow roller body 240, and a follow roller shaft 241.

The follow roller body 240 is generally cylindrical in shape and elongated in the left-right direction. The follow roller body 240 has the same diameter as the drive roller body 238 and is retained in the transfer frame 231 such that its top peripheral portion is disposed at approximately the same vertical position as the top peripheral portion of the drive roller body 238. The left-right length of the follow roller body 40 is slightly shorter than the left-right dimension of the endless conveying belt 221.

The follow roller shaft 241 is inserted through the follow roller body 240 such that both left and right ends are exposed on the outside thereof. The follow roller shaft 241 is generally rod-shaped, with its longitudinal dimension oriented along the central axis of the follow roller body 240. The left-right length of the follow roller shaft 241 is greater than the left-right dimension of the endless conveying belt 221. Both left and right ends of the follow roller shaft 241 are fixed to the left and right ends of the follow roller body 240 with flange members (not shown) so that the follow roller shaft 241 is incapable of rotating relative to the follow roller body 240.

The left and right ends of the follow roller shaft 241 are inserted into the corresponding follow-roller-shaft insertion openings 236 formed in the left and right sides of the transfer frame 231 and are capable of both rotating and moving forward and rearward within the follow-roller-shaft insertion openings 236 (see FIG. 13A).

In other words, the follow roller 220 is disposed downstream side of the drive roller 219 in the withdrawal direction X.

Further, the left and right ends of the follow roller shaft 241 contact the front ends of the compression springs 229 in the corresponding follow-roller-shaft insertion openings 236 from the front sides thereof (see FIG. 13A). Thus, the elastic force of the compression springs 229 constantly urges the follow roller 220 forward.

Each of the transfer rollers 222 is configured of a transfer roller body 242, and a transfer roller shaft 243.

The transfer roller body 242 is generally cylindrical in shape and elongated in the left-right direction. The transfer roller body 242 is formed of an electrically conductive resin material and has a smaller outer diameter than the outer diameters of the drive roller body 38 and follow roller body 240. The transfer rollers 222 are retained in the transfer frame 231 so that the top peripheral portions of the transfer roller bodies 242 are at substantially the same vertical position as the top peripheral portion of the drive roller body 238.

The transfer roller shaft 243 is formed of a metal in a general rod shape whose longitudinal dimension is oriented along the central axis of the transfer roller body 242.

The endless conveying belt 221 is formed of an electrically conductive resin material. The endless conveying belt 221 is a wide belt formed in a continuous loop having sufficient length to be placed around the drive roller 219 and follow roller 220.

(2) Belt Cleaner

The belt cleaner 232 is disposed inside the front end of the transfer frame 231. The belt cleaner 232 includes a cleaner frame 244, a cleaning blade 245, and a first screw 261.

The cleaner frame 244 is formed in a generally cylindrical shape that is closed on both left and right ends and open on the lower rear side. More specifically, the cleaner frame 244 is integrally provided with a pair of left and right side walls 246, a main body 247, and a top wall 248.

The side walls 246 have a flat plate shape and are generally rectangular in a side view. The side walls 246 are arranged parallel to each other and are spaced apart in the left-right direction, with the gap between side walls 246 in the left-right direction being greater than the left-right length of the follow roller body 240 and shorter than the gap between the left and right side walls of the transfer frame 231. As shown in FIG. 12B, follow-roller-shaft insertion holes 250 are formed one in each of the side walls 246.

The follow-roller-shaft insertion holes 250 are generally circular in a side view and penetrate the side walls 246 near the rear ends thereof. The follow-roller-shaft insertion holes 250 have a diameter that is approximately equivalent to (slightly greater than) the outer diameter of the follow roller shaft 241.

As shown in FIG. 12B, the left side wall 246 is provided with a screw insertion hole 251, and a cleaner-side supported part 252.

The screw insertion hole 251 has a generally circular shape in a side view and is formed near the front end of the side wall 246. The screw insertion hole 251 has a diameter that is slightly larger than the major diameter of the first screw 261 (described later) constituting a lift 262.

The cleaner-side supported part 252 is generally cylindrical in shape and extends leftward from the peripheral edge portion of the screw insertion hole 251. The cleaner-side supported part 252 has a smaller outer diameter than the inner diameter of the support part 237 constituting the transfer frame 231. The cleaner-side supported part 252 includes a cleaner-side sealing member 253 (see FIG. 14).

The cleaner-side sealing member 253 is affixed to the outer peripheral surface of the cleaner-side supported part 252 so as to cover the entire outer peripheral surface thereof (see FIG. 14). The cleaner-side sealing member 253 is formed of an elastic material, such as a sponge or nonwoven cloth.

The main body 247 bridges the front ends of the side walls 246. The main body 247 has a general columnar shape elongated in the left-right direction, with a generally D-shaped cross section curved on the front side thereof. A recovery chamber 249 is formed inside the main body 247.

The recovery chamber 249 is a recessed groove formed in the rear side of the main body 247 and is elongated in the left-right direction. A cross section of the recovery chamber 249 is generally U-shaped and open on the rear side. The recovery chamber 249 spans across the entire left-right dimension of the main body 247.

The top wall 248 has a generally flat plate shape that extends rearward from the top edge of the main body 247. The rear edge of the top wall 248 extends to a position farther rearward than the follow roller shaft 241 and forward of the forwardmost transfer roller 222 in a vertical projection.

The cleaning blade 245 is provided on the rear edge constituting the top portion of the main body 247. The cleaning blade 245 is generally plate-shaped and elongated in the left-right direction with substantial thickness in the front-rear direction. The upper half of the cleaning blade 245 is fixed to the portion of the main body 247 forming the top peripheral edge of the recovery chamber 249. The lower half of the cleaning blade 245 confronts the upper half of the recovery chamber 249.

As shown in FIG. 14, the first screw 261 is disposed inside the recovery chamber 249 and extends in the left-right direction thereof. The first screw 261 is a right-handed auger screw whose rotational center (hereinafter called a rotational center Y) is aligned with the rotational axis of the support part 237 in the transfer frame 231. The right end portion of the rotational shaft constituting the first screw 261 is rotatably supported in the right side wall 246 of the belt cleaner 232, and the left end portion of the rotational shaft penetrates the left wall of a lift-side supported part 263 (described later) provided in the lift 262 and is rotatably supported therein.

The first screw 261 also includes a screw drive gear 274 and a film member 273.

The screw drive gear 274 is nonrotatably supported on the left end portion of the rotational shaft constituting the first screw 261 and is positioned on the left side of the left wall constituting the lift-side supported part 263 (described later).

The film member 273 is disposed inside the lift-side supported part 263 described later and extends radially outward from the outer peripheral surface of the rotational shaft constituting the first screw 261 at the left end portion of the rotational shaft. The film member 273 is formed of a flexible film that is flat and generally rectangular in shape.

The belt cleaner 232 is coupled to the follow roller 220 by inserting both left and right ends of the follow roller shaft 241 into the follow-roller-shaft insertion holes 250 formed in the side walls 246.

The bottom edge of the cleaning blade 245 confronts the front side of the follow roller 220 with the endless conveying belt 221 interposed therebetween and, hence, contacts the front side of the endless conveying belt 221 looped around the follow roller 220.

As shown in FIGS. 11 and 14, the belt cleaner 232 is supported in the transfer frame 231 by fitting the cleaner-side supported part 252 into the support part 237 formed in the transfer frame 231 from the right side thereof.

At this time, the cleaner-side sealing member 253 contacts the right end portion of the support-part-side sealing member 230 in the transfer frame 231 (see the enlarged view in FIG. 14). The cleaner-side sealing member 253 can also be compressed in its thickness direction (i.e., the radial direction of the cleaner-side supported part 252).

As a result, the belt cleaner 232 can move relative to the transfer frame 231 in the front-rear direction a distance equivalent to the compressible amount of the cleaner-side sealing member 253.

(3) Lift

As shown in FIGS. 13 and 14, the lift 262 is rotatably supported in the support part 237 of the transfer frame 231. The lift 262 includes a lift-side supported part 263, and an intermediary conveying part 264. In the following description of the lift 262, it will be assumed that the lift 262 is disposed in a coupled position described later (see FIG. 13A).

As shown in FIG. 14, the lift-side supported part 263 is generally cylindrical in shape, with a closed left end, and is elongated in the left-right direction. The outer diameter of the lift-side supported part 263 is smaller than the inner diameter of the support part 237 constituting the transfer frame 231 and larger than the outer diameter of the cleaner-side supported part 252. The lift-side supported part 263 includes a lift-side sealing member 265.

The lift-side sealing member 265 is affixed to the outer peripheral surface of the lift-side supported part 263 on the right end thereof and covers the entire peripheral surface of this right end portion. The lift-side sealing member 265 is formed of an elastic material such as a sponge or nonwoven cloth.

As shown in FIG. 13A, the intermediary conveying part 264 is formed continuously with the top of the lift-side supported part 263 (one radial side of the lift-side supported part 263) on the left end thereof. The intermediary conveying part 264 is shaped like a hollow cylinder elongated in the left-right direction. The rear side portion of the intermediary conveying part 264 is cut out to give the intermediary conveying part 264 a general fan shape in a side view.

The intermediary conveying part 264 is configured of a first peripheral wall 275, a second peripheral wall 276, and a connecting wall 77.

The first peripheral wall 275 constitutes the portion of the intermediary conveying part 264 on the front side. The first peripheral wall 275 is generally cylindrical in shape, elongated in the left-right direction, and open on the rear end to form a general fan shape in a side view.

The second peripheral wall 276 constitutes the portion of the intermediary conveying part 264 on the rear side. The second peripheral wall 276 is generally cylindrical in shape, is elongated in the left-right direction, and is open on the front side to form a general fan shape in a side view. The second peripheral wall 276 shares its central axis with the first peripheral wall 275, but has a smaller diameter than the first peripheral wall 275. Both the first peripheral wall 275 and second peripheral wall 276 of the intermediary conveying part 264 have a larger diameter than the lift-side supported part 263.

The connecting wall 277 is provided on the rear side of the intermediary conveying part 264. The connecting wall 277 has a flat plate shape and extends downward from the upper rear edge of the first peripheral wall 275, connecting the first peripheral wall 275 to the upper peripheral surface of the second peripheral wall 276. The upper front edge of the second peripheral wall 276 extends slightly forward of the connecting wall 277.

A storage space 279 is formed inside the intermediary conveying part 264 and is defined by the left and right walls of the intermediary conveying part 264, the first peripheral wall 275, the second peripheral wall 276, and the connecting wall 277.

A conveying-unit-side through-hole 271 is formed in the right wall of the intermediary conveying part 264. The conveying-unit-side through-hole 271 is circular in a side view and penetrates the side wall of the intermediary conveying part 264 to provide communication between the storage space 279 and the exterior of the intermediary conveying part 264.

The intermediary conveying part 264 also includes a rotary member 266, and a first shutter 272.

The rotary member 266 includes a rotational shaft 267, a rotary member drive gear 269, and a film member 268.

The rotational shaft 267 has a general columnar shape, with its axis aligned with the central axis of the intermediary conveying part 264. The right end of the rotational shaft 267 is rotatably supported in the right wall of the intermediary conveying part 264. The left end of the rotational shaft 267 is rotatably supported in the left wall of the intermediary conveying part 264 and penetrates the left wall to the left side thereof.

The rotary member drive gear 269 is nonrotatably supported on the left end of the rotational shaft 267 on the left side of the left wall constituting the intermediary conveying part 264.

The film member 268 is provided inside the intermediary conveying part 264, extending radially outward from the outer peripheral surface of the rotational shaft 267. The film member 268 is formed of a flexible film that is flat and generally rectangular in shape.

The first shutter 272 includes a pair of side walls 280 opposing each other in the left-right direction, and a top wall 281 bridging the upper edges of the side walls 280.

The side walls 280 are positioned parallel to one another and are separated a distance in the left-right direction greater than the left-right dimension of the intermediary conveying part 264.

In a side view, the side walls 280 are generally shaped like a fan whose central angle is approximately 30 degrees.

The side walls 280 include a left wall 280L, and a right wall 280R.

The left wall 280L is provided with an annular part 282.

The annular part 282 is provided on the lower end of the left wall 280L in the central angle part thereof. The annular part 282 is annular shaped in a side view. A hole penetrates the annular part 282 in the left-right direction.

A support boss 283 and a contact-receiving boss 284 are formed on the right wall 280R.

The support boss 283 has a generally columnar shape and protrudes leftward from the bottom end of the right wall 280R in the central angle portion thereof.

The contact-receiving boss 284 has a generally columnar shape and protrudes rightward from the upper rear edge of the right wall 280R.

The annular part 282 is fitted around the rotational shaft 267 of the rotary member 266 and is rotatably supported thereon. The annular part 282 shares its central axis with the rotational shaft 267 and is capable of rotating relative to the left wall of the intermediary conveying part 264. The support boss 283 shares its central axis with the rotational shaft 267. The left end of the support boss 283 is rotatably supported in the right wall of the intermediary conveying part 264. Accordingly, the first shutter 272 is rotatably supported on the intermediary conveying part 264 with its rotational center aligned with the center axis of the rotational shaft 267.

The first shutter 272 is capable of rotating forward and rearward along the circumferential direction of the intermediary conveying part 264 between a closed position (indicated by the solid lines in FIG. 13A) in which the right wall 280R closes the conveying-unit-side through-hole 271, and an open position (indicated by the dashed lines in FIG. 13A) forward of the closed position for exposing the convey in-unit-side through-hole 271.

The lift 262 is supported on the transfer frame 231 by fitting the lift-side supported part 263 into the support part 237 of the transfer frame 231 from the left side thereof.

At this time, a slight gap is formed between the right side of the lift-side supported part 263 and the opposing left side of the cleaner-side supported part 252. Further, the lift-side sealing member 265 is in contact with the support-part-side sealing member 230 to the left of the cleaner-side sealing member 253. The lift-side sealing member 265 is almost completely compressed in its thickness direction (i.e., the radial direction of the cleaner-side supported part 252) at this time so that it would be nearly impossible to compress the lift-side sealing member 265 further.

Hence, the lift 262 is capable of rotating relative to the transfer frame 231, but is incapable of moving in the front-rear direction relative to the transfer frame 231.

With this construction, the lift 262 can rotate about the rotational center Y of the lift-side supported part 263 between a first position (see FIG. 13A) in which the intermediary conveying part 264 is positioned above the lift-side supported part 263, and a second position (see FIG. 13B) in which the intermediary conveying part 264 is positioned forward of the lift-side supported part 263.

3. Detailed Structure of the Process Unit (1) Process Frame

As shown in FIG. 8, the process frame 11 includes a pair of side walls 260, a front beam 255, a rear beam 256, and a paper guide 257.

The side walls 260 have a flat plate shape that is generally rectangular in a side view and elongated in the front-rear direction. The side walls 260 are arranged parallel to each other and are separated in the left-right direction.

The front beam 255 bridges the front edges of the side walls 260. The front beam 255 has a generally flat plate shape that is rectangular and elongated in the left-right direction. A grip part 258 is provided on the front surface of the front beam 255. The user grips the grip part 258 when mounting the process frame 211 in or removing the process frame 211 from the main casing 202.

The rear beam 256 bridges the rear edges of the side walls 260. The rear beam 256 has a generally flat plate shape that is rectangular and elongated in the left-right direction.

The paper guide 257 is disposed in the lower front portion of the process frame 211 and is positioned below and forward of the black developer cartridge 212K. The paper guide 257 has a generally flat plate shape that curves upward in the middle portion.

The front edge of the paper guide 257 is positioned above the sheet-feeding unit 203, and the rear edge is disposed on the lower front side of the black photosensitive drum 213K and the upper front side of the endless conveying belt 221.

(2) Developer Cartridges

Figure 17:
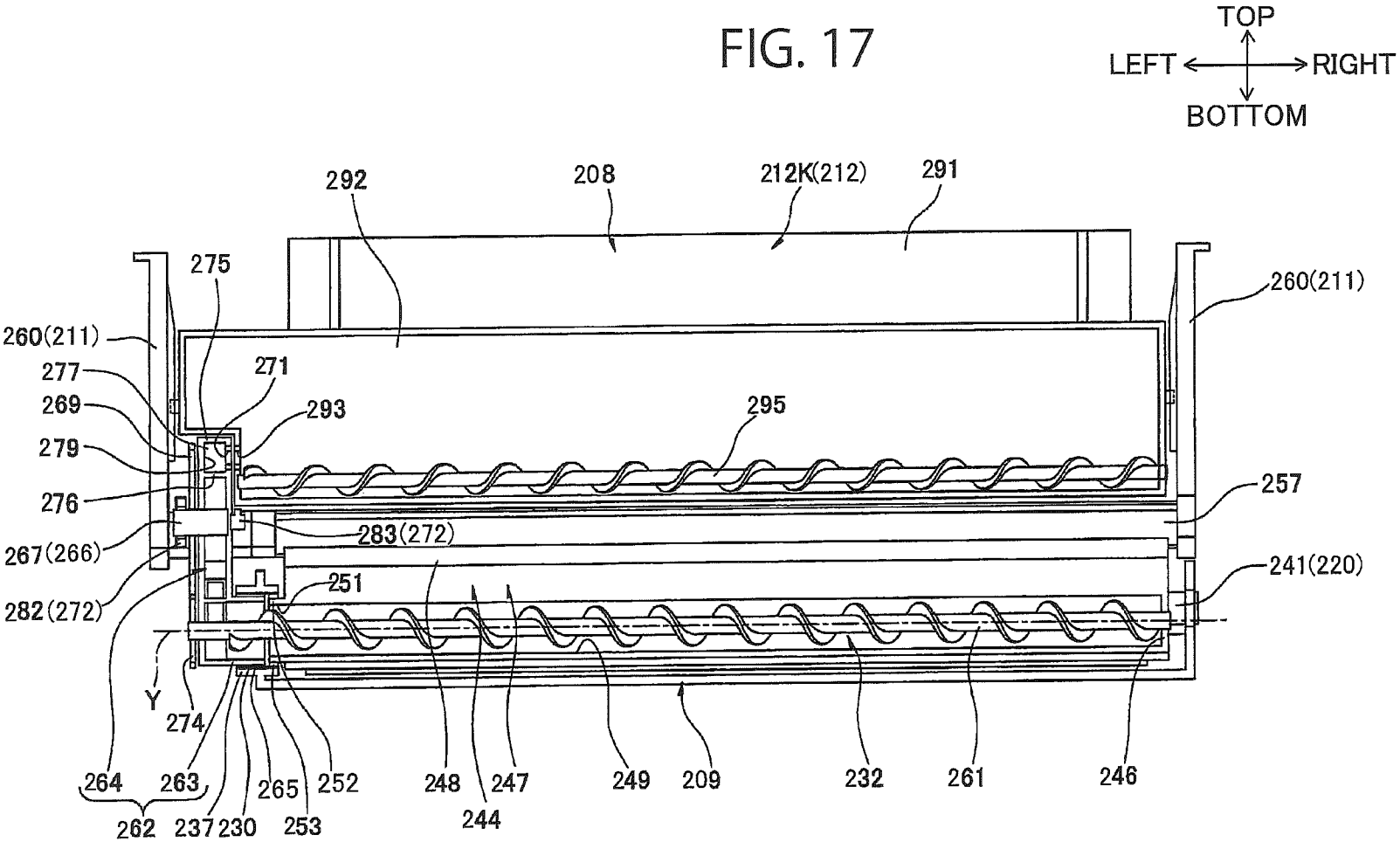
FIG. 17 is a cross-sectional view of the lift along a E-E line in FIG. 15.
Figure 18:
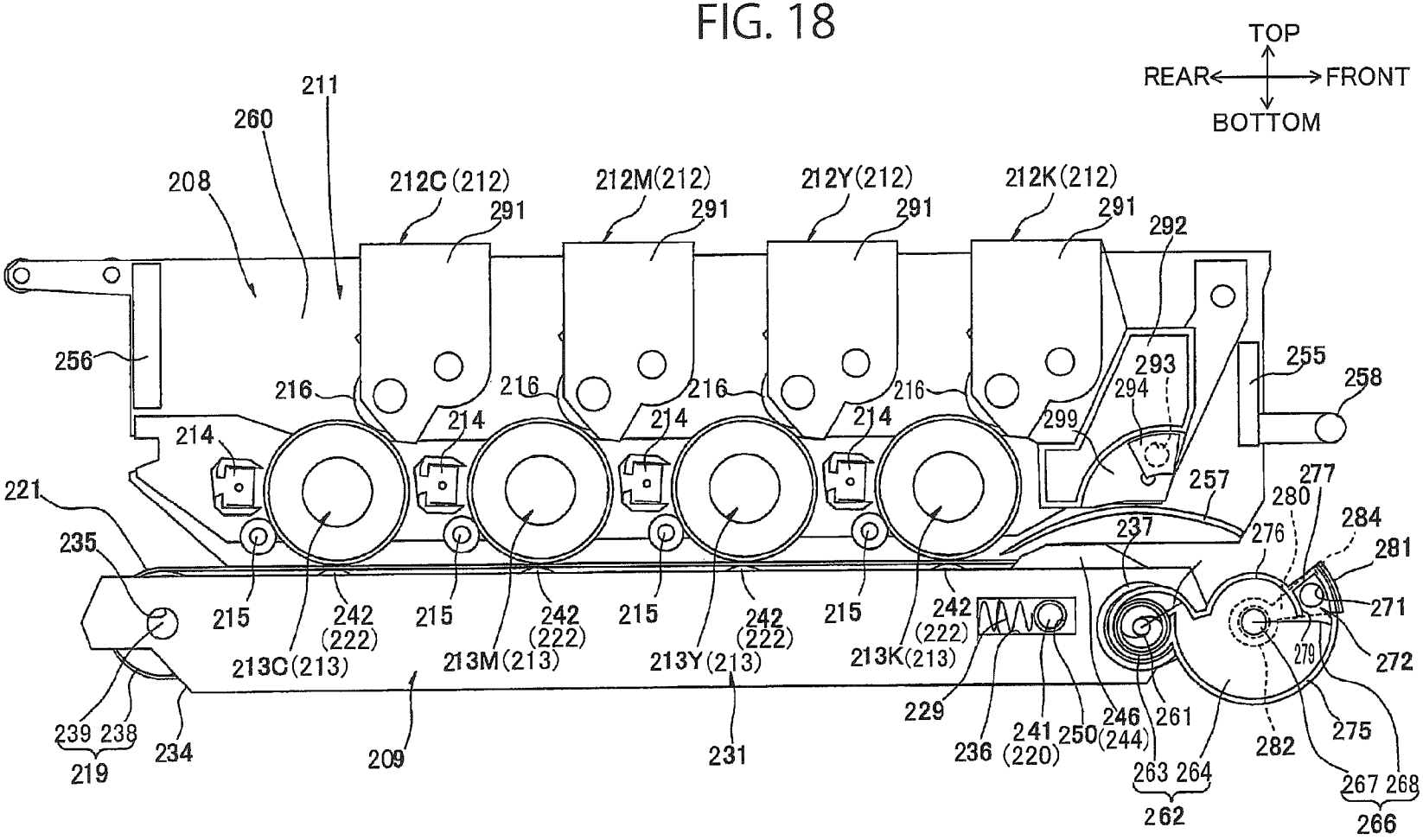
FIG. 18 is an explanatory diagram showing a coupling with the lift and the storage unit; and in which the lift and the storage unit is uncoupled.

As shown in FIG. 17, each developer cartridge 212 is provided with a developer case 291.

The developer case 291 has a box-like shape that is elongated in the left-right direction.

As described above, the developing roller 216, supply roller 217, and thickness-regulating blade 218 are supported in the bottom portion of the developer case 291, while the upper portion of the developer case 291 serves to accommodate toner.

The black developer cartridge 212K is further provided with a storage section 292.

The storage section 292 is provided on the lower front side of the black developer cartridge 212K. That is, the storage section 292 is positioned below the black developer cartridge 212K and on the downstream side of the same in the withdrawal direction X. The storage section 292 is also positioned above the paper guide 257.

The storage section 292 is integrally provided with the black developer cartridge 212K.

The storage section 292 further includes a coupling depression 299, a storage-section-side through-hole 293, a second shutter 294, and a second screw 295.

The coupling depression 299 is formed in the lower front corner of the storage section 292 and is recessed rightward in the left wall of the storage section 292. The coupling depression 299 is generally fan-shaped in a flat side view.

The surface on the upper edge of the coupling depression 299 has approximately the same radius of curvature as the top surface of the lift 262.

The left-right dimension of the coupling depression 299 is greater than that of the lift 262.

The storage-section-side through-hole 283 is formed in the left wall of the storage section 292 near the top edge of the coupling depression 299 and penetrates the storage section 292 in the left-right direction.

Figure 16A:
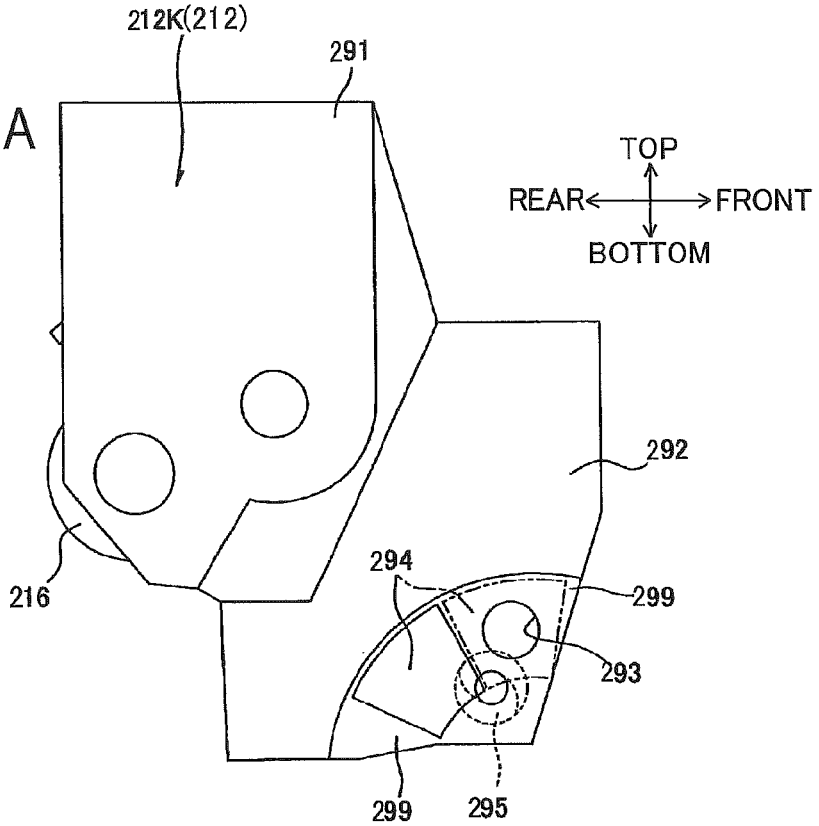
FIG. 16A is a left side view of the storage unit shown in FIG. 15.

As shown in FIG. 16A, the second shutter 294 is provided on the left side of the storage section 292.

The second shutter 294 is plate-shaped and generally trapezoidal in a side view, with its width expanding toward the upper rear side. The upper rear edge of the second shutter 294 is curved to conform to the surface forming the upper edge of the coupling depression 299. The second shutter 294 is supported in the coupling depression 299 through a sliding mechanism (not shown).

The second shutter 294 is capable of moving between closes position (indicated by the dashed lines in FIG. 16A) in which the right surface of the second shutter 294 covers the storage-section-side through-hole 293, and an open position (indicated by the solid lines in FIG. 16A) to the rear side of the closed position for exposing the storage-section-side through-hole 293.

Figure 16B:
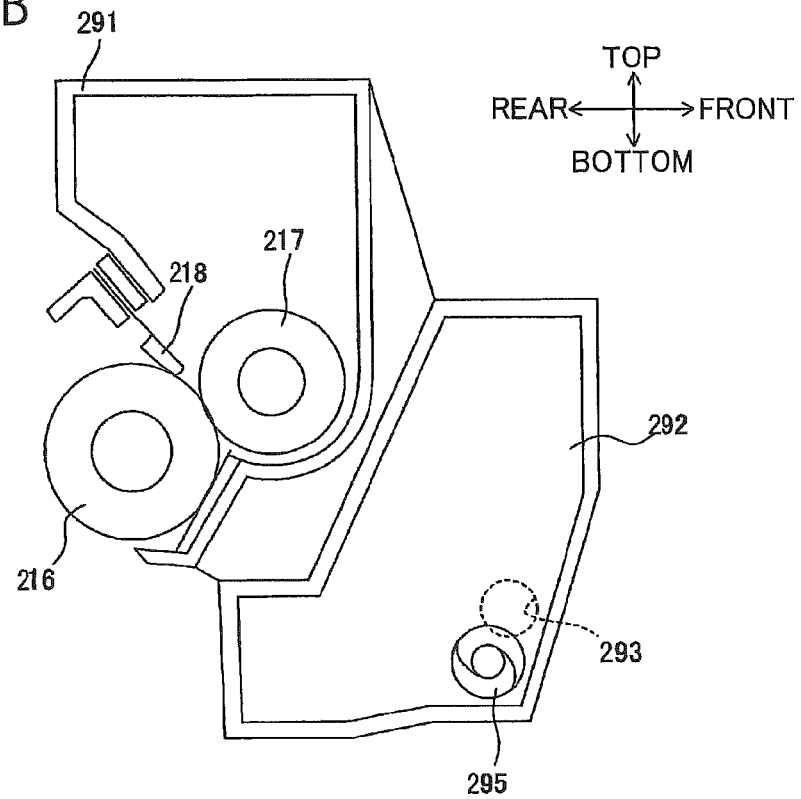
FIG. 16B is a vertical cross-sectional view of the storage unit shown in FIG. 15.

The second screw 295 is a left-handed auger screw that is oriented in the left-right direction. The second screw 295 is disposed in the bottom of the storage section 292 as shown in FIGS. 16A and 16B.

The right end of the second screw 295 is rotatably supported in the right wall of the storage section 292, and the left end is rotatably supported in the left wall of the storage section 292 beneath the lower peripheral edge of the storage-section-side through-hole 293 (see FIG. 17).

(3) Mounted State of the Process Unit

Figure 15:
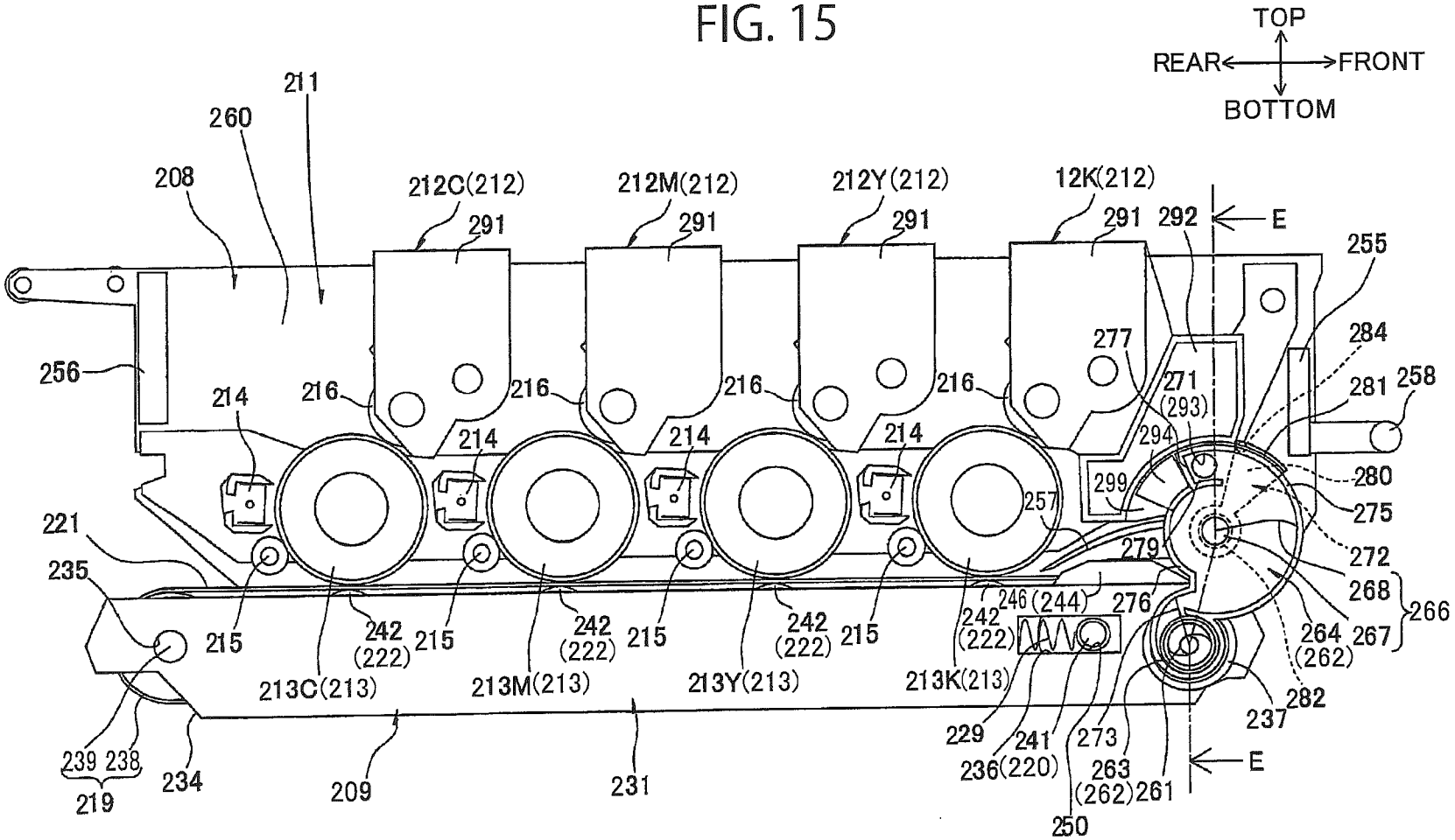
FIG. 15 is an explanatory diagram showing a coupling with the lift and a storage unit; and in which the lift and the storage unit is coupled.

When the process unit 208 is disposed in its internal position (see FIG. 10), each of the photosensitive drums 213 contacts the upper portion of the endless conveying belt 221, as illustrated in FIGS. 15 and 17.

At this time, the first shutter 272 of the lift 262 is disposed in the open position indicated by the dashed lines in FIG. 13A for exposing the conveying-unit-side through-hole 271, and the second shutter 294 of the storage section 292 is disposed in the open position indicated by the solid lines in FIG. 16A for exposing the conveying-unit-side through-hole 271, and the second shutter 294 of the storage section 292 is disposed in the open position indicated by the solid lines in FIG. 16A for exposing the storage-section-side through-hole 293.

Further, the lift 262 is disposed in the first position shown in FIG. 13A in which the lift 262 is above the lift-side supported part 263.

The conveying-unit-side through-hole 271 and storage-section-side through-hole 293 are positioned adjacent to each other in the left-right direction and overlap each other in a left-right projection. Thus, the supply roller 217 and storage-section-side through-hole 293 provide communication between the interiors of the lift 262 and storage section 292.

(4) Operations for Recovering Matter Deposited on the Conveying Belt and Photosensitive Drums Prior to executing the image-forming operation described earlier, the printer 201 directly transfers toner onto the surface of the endless conveying belt 221 to form a printed pattern (patches).

As the endless conveying belt 221 circulates, bringing the printed pattern opposite the patch sensor 227 on the lower side of the transfer unit 209, the patch sensor 227 reads the printed pattern and measures positional offset and image density for each printed color.

As the endless conveying belt 221 continues to circulate, the printed pattern passes through the area in which the cleaning blade 245 contacts the endless conveying belt 221. The cleaning blade 245 scrapes off waste toner, paper dust, and other matter deposited on the endless conveying belt 221.

The matter scraped off the endless conveying belt 221 by the cleaning blade 245 is collected in the recovery chamber 249.

The first screw 261 shown in FIG. 11 rotates clockwise in a left side view. The first screw 261 conveys deposited matter accumulated in the recovery chamber 249 leftward and supplies the matter into the lift-side supported part 263 of the lift 262.

In other words, the first screw 261 serves to convey the deposited matter to the left side (to the left side relative to the axial direction of the photosensitive drums 213).

The film member 273 shown in FIG. 17 rotates clockwise in a left side view. The film member 273 conveys deposited matter supplied to the lift-side supported part 263 upward and supplies this matter into the intermediary conveying part 264.

The film member 268 rotates counterclockwise in a left side view. The film member 268 conveys deposited matter supplied to the intermediary conveying part 264 upward to be stored temporarily in the storage space 279. The deposited matter is subsequently supplied out of the intermediary conveying part 264 through the conveying-unit-side through-hole 271 and into the storage section 292 via the storage-section-side through-hole 293.

The second screw 295 in the storage section 292 rotates clockwise in a left side view for conveying deposited matter supplied into the storage section 292 via the storage-section-side through-hole 293 rightward. Hence, after the lift 262 conveys deposited matter to the storage section 292, the operation for recovering deposited matter is complete.

The image-forming operation described above is executed after measuring positional offset and image density for each printed color. when transferring toner images from the photosensitive drums 213 to a sheet P, some of the toner may remain on the peripheral surfaces of the photosensitive drums 213. For this reason, a cleaning bias is applied to the drum cleaning rollers 215. As the photosensitive drums 213 rotate, bringing the residual toner on the surfaces of the drum cleaning rollers 215 across from the corresponding drum cleaning rollers 215, the cleaning bias attracts the residual toner to the outer surfaces of the drum cleaning rollers 215, and the residual toner is temporarily retained by the drum cleaning rollers.

After completing this image-forming operation and prior to executing the next image-forming operation, the printer 201 recovers the waste toner and other deposited matter retained on the drum cleaning rollers 215.

To recover the waste toner, the printer 201 applies a bias of reverse polarity to the cleaning bias to the four drum cleaning rollers 215, causing the waste toner temporarily retained on the drum cleaning rollers 215 to be released onto the endless conveying belt 221 via the corresponding photosensitive drums 213.

Subsequently, as the endless conveying belt 221 continues to circulate, the waste toner released onto the endless conveying belt 211, along with paper dust and other deposited matter on the endless conveying belt 221, passes along the bottom of the transfer unit 209 and is brought into contact with the cleaning blade 245.

Accordingly, the cleaning blade 245 scrapes off the deposited matter released from the drum cleaning rollers 215 onto the endless conveying belt 221, and the matter is collected in the recovery chamber 249.

The matter collected in the recovery chamber 249 is conveyed to the storage section 292, as described above.

4. Operations for Replacing a Developer Cartridge

To replace one of the developer cartridges 212, first the user pulls the process frame 211 out from the main casing 202 to the external position shown in FIG. 19.

To pull the process frame 211 out to the external position, the user opens the front cover 205 of the main casing 202 by rotating the front cover 205 forward and downward about its bottom edge.

Figure 13B:
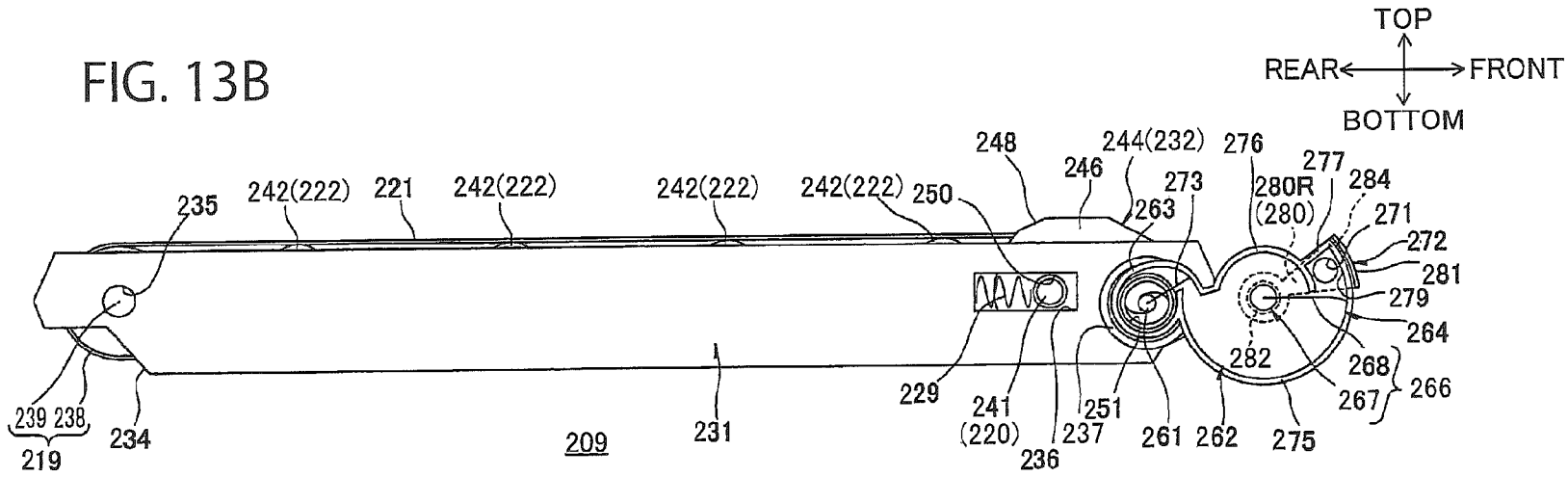

Next, the user rotates the lift 262 about the rotational center Y from the first position shown in FIG. 13A to the second position shown in FIG. 13B. Once the lift 262 arrives in the second position, the lift 262 is no longer in the path of the process frame 211.

Next, the user rotates the first shutter 272 to its closed position indicated by solid lines in FIG. 13A for closing the conveying-unit-side through-hole 271, and slides the second shutter 294 to the closed position indicated by the dashed lines in FIG. 16A for covering the storage-section-side through-hole 293.

Next, the user grips the grip part 258 and pulls the process frame 211 forward, thereby placing the process frame 211 in the external position on the outside of the main casing 202.

When the process frame 211 is in the external position, the photosensitive drums 213 are no longer in contact with the endless conveying belt 221.

To remove the developer cartridge 212 to be replaced from the process frame 211, the user pulls the developer cartridge 212 upward from the process frame 211.

When removing the black developer cartridge 212K from the process frame 211, the storage section 292 is removed together with the black developer cartridge 212K.

Accordingly, the user can perform maintenance on the storage section 292 after removing the black developer cartridge 212K from the process frame 211.

To mount a new developer cartridge 212 into the process frame 211, the user positions the developer cartridge 212 above the process frame 211 and pushes the developer cartridge 212 downward into the process frame 211.

When mounting a new black developer cartridge 212K into the process frame 211, the storage section 292 is mounted together with the black developer cartridge 212K.

Next, the user grips the grip part 258 and pushes the process frame 211 rearward into the main casing 202 until the process frame 211 is in its internal position shown in FIG. 10.

Next, the user rotates the lift 262 about the rotational center Y from the second position shown in FIG. 13B to the first position shown in FIG. 13A. Upon arriving in the first position, the lift 262 is again positioned along the path of the process frame 211.

Further, when the lift 262 is rotated into the first position, the upper edge of the lift 262 is accommodated inside the coupling depression 200, as shown in FIG. 17.

Further, when the lift 262 is rotated into the first position, the top end of the lift 262 contacts the front edge of the second shutter 294 disposed in the coupling depression 299. The contact from the lift 262 slides the second shutter 294 into its open position indicated by solid lines in FIG. 16A, exposing the storage-section-side through-hole 293.

At the same time, the contact-receiving boss 284 on the first shutter 272 contacts the front wall of the storage section 292, rotating the first shutter 272 to its open position indicated by dashed lines in FIG. 13A for exposing the conveying-unit-side through-hole 271.

Once the lift 262 is disposed in the coupled position, the conveying-unit-side through-hole 271 and storage-section-side through-hole 293 are positioned adjacent to each other and are aligned in the left-right direction, allowing for communication between the interiors of the lift 262 and storage section 292. This completes the operation for mounting the process unit 208 in the main casing 202.

5. Operational Advantages (1) As shown in FIG. 19, the cleaning blade 245 of the printer 201 described above is fixed in position relative to the endless conveying belt 221 and does not separate from the endless conveying belt 221 when the process frame 211 is moved into the external position.

Accordingly, deposited matter is unlikely to drop off the cleaning blade 245 when the process frame 211 is moved.

Further, the storage section 292 is retained on the black developer cartridge 212K of the process frame 211. The lift 262 is coupled to the storage section 292 when in the first position shown in FIG. 10 and is uncoupled from the storage section 292 and retracted out of the path of the process frame 211 when in the second position shown in FIG. 19.

Hence, deposited matter removed by the belt cleaner 232 can be conveyed to the storage section 292 when the lift 262 is disposed in the second position. Thus, the above configuration achieves reliable recovery of the deposited matter and facilitates maintenance of the storage section 292.

(2) As shown in FIG. 11, the printer 201 according to the second embodiment can accumulate deposited matter on its left side (the side on one axial end of the photosensitive drums 213). Accordingly, the lift 262, which is moved between the first position and the second position, can be made more compact in the left-right direction, facilitating movement of the lift 262.

(3) As shown in FIG. 13, the rotational shaft of the lift 262 is aligned with the rotational center Y of the first screw 261 (see FIG. 14). Since the lift 262 rotates about the rotational center Y, deposited matter can be securely transferred from the first screw 261 to the lift 262 without leaking, even when the lift 262 moves. Further, the lift 262 is reliably coupled to the storage section 282 and reliably conveys deposited matter from the first position, and is reliably uncoupled from the storage section 292 when disposed in the second position.

Figure 12A:
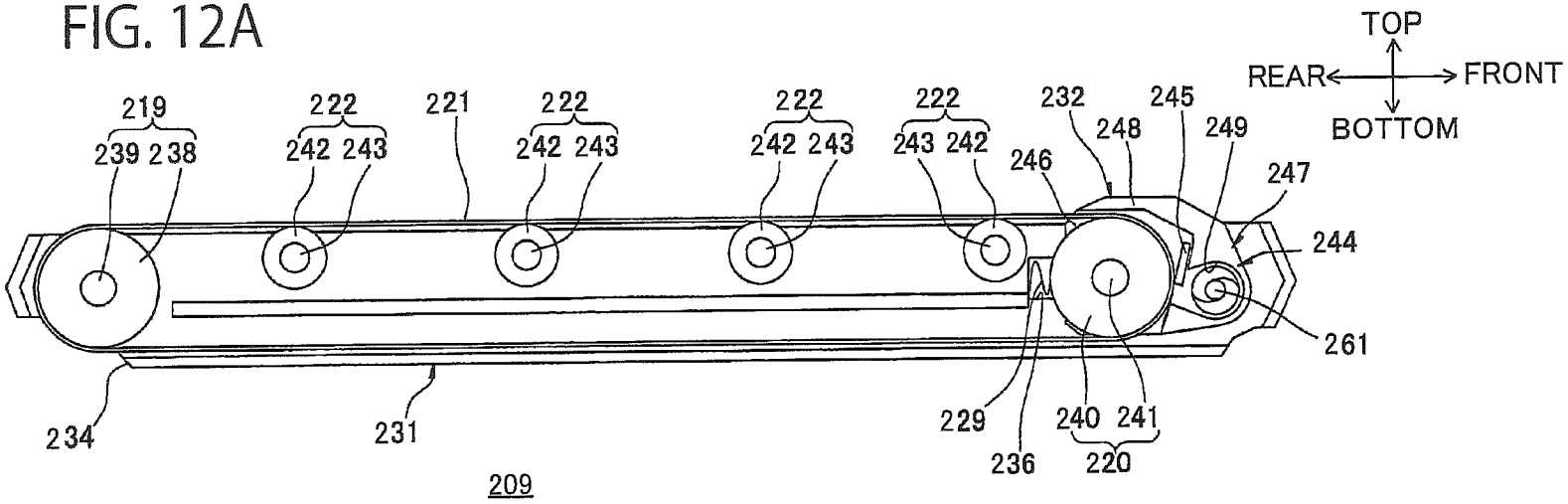
Figure 12B:
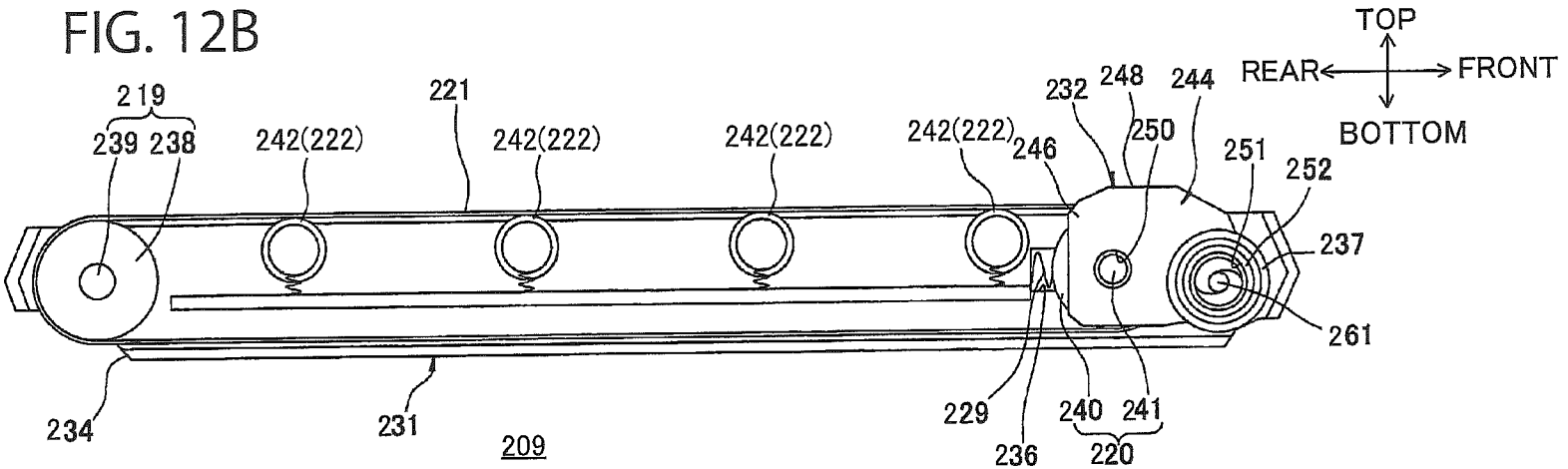

(4) As shown in FIG. 12A, the endless conveying belt 221 is interposed between the cleaning blade 245 and the follow roller body 240 of the follow roller 220.

Accordingly, the follow roller body 240 can receive the pressure applied by the cleaning blade 245 contacting the endless conveying belt, 221, ensuring that the cleaning blade 245 makes reliable contact with the endless conveying belt 221.

This construction ensures that deposited matter on the endless conveying belt 221 can be removed reliably.

(5) Further, providing the storage section 292 on the downstream side of the process frame 211 in the withdrawal direction X facilitates operations for replacing the storage section 292, as illustrated in FIG. 19. This configuration also facilitates operations of the lift 262 for coupling and uncoupling the lift 262 and the storage section 292, since the lift 262 is disposed on the downstream side of the printer 201 in the withdrawal direction X.

(6) With the printer 201 according to the second embodiment, the storage section 292 can be replaced when replacing the black developer cartridge 212K, improving the efficiency of replacing the storage section 292.

(7) As shown in FIG. 17, the structure of the printer 201 reduces the distance between the storage section 292 and the cleaning blade 245 fixed on the endless conveying belt 221 by positioning the storage section 292 lower (closer to the endless conveying belt 221).

This configuration shortens the path required for conveying deposited matter from the cleaning blade 245 to the storage section 292, ensuring greater reliability for conveying deposited matter to the storage section 292.

(8) Further, since the storage section 292, belt cleaner 232, and lift 262 are all provided in the front side of the printer 201 according to the second embodiment, the user can more easily operate the lift 262 and open and close the first shutter 272 and second shutter 294.

While the invention has been described in detail with reference to the embodiments thereof, it would be apparent to those skilled in the art that various changes and modifications may be made therein without departing from the spirit of the invention.

What is claimed is:

1. An image forming device comprising:

a drive roller;

a follow roller spaced apart a predetermined distance from the drive roller;

an endless belt looped over the drive roller and the follow roller;

a cleaning member disposed to confront the follow roller with the endless belt interposed therebetween and configured to remove residual toner on the endless belt;

a first case configured to support the drive roller, the first case including a first case side coupling part;

a second case configured to support both the follow roller and the cleaning member and be movable relative to the first case in a predetermined direction, the second case including:

an elastic member that is elastically deformable; and a second case side coupling part coupled to the first case side coupling part through the elastic member that allows the second case to move relative to the first case in the predetermined direction;

a storage member provided outside of the second case and configured to store the residual toner removed by the cleaning member; and a conveying unit configured to convey the residual toner removed by the cleaning member to the storage member, the conveying unit including a conveying unit side coupling part coupled to the first case side coupling part.

2. The image forming device according to claim 1, wherein the second case side coupling part is coupled to the first case side coupling part from inside of the first case, and the conveying unit side coupling part is coupled to the first case side coupling part from outside of the first case.

3. The image forming device according to claim 1, wherein a selected one of the first case side coupling part and the second case side coupling part is inserted into a non-selected one of the first case side coupling part and the second case side coupling part.

4. The image forming device according to claim 1, wherein the elastic member is a sponge.

5. The image forming device according to claim 1, wherein the elastic member includes:

a first elastic member provided in the first case side coupling part; and a second elastic member provided in the second case side coupling part, the second elastic member contacting the first elastic member.

6. The image forming device according to claim 1, wherein the first case side coupling part, the second case side coupling part and the conveying unit side coupling part are disposed on one axial end side of the follow roller; and wherein the second case includes a conveying member configured to convey the residual toner removed by the cleaning member toward the one axial end side.

7. The image forming device according to claim 6, wherein the conveying member has one end on the one axial end side, the one end of the conveying member protruding from one axial end of the second case side coupling part into the conveying unit side coupling part.

8. The image forming device according to claim 7, wherein the conveying member is flexible, the conveying member having another end on another axial end side of the follow roller, the other end of the conveying member being supported by the second case, the one end of the conveying member being supported by the conveying unit.

9. The image forming device according to claim 1, wherein the conveying unit is configured to rotate about a center of the conveying unit side coupling part.

10. An image forming device comprising:

a main body;

a plurality of developer accommodating members configured to accommodate developer;

a retaining member configured to retain the plurality of developer accommodating members and be movable between an internal position inside the main body and an external position outside the main body;

a belt unit that includes:

a first roller;

a second roller; and an endless belt looped around the first roller and the second roller;

a first cleaning unit that includes:

a first cleaning member fixedly positioned and configured to remove residual toner on the endless belt;

a storage member supported by the retaining member and configured to store the residual toner removed by the first cleaning unit; and a conveying unit configured to convey the residual toner removed by the first cleaning unit to the storage member and be movable between a first position and a second position, the conveying unit being coupled to the storage member and positioned along a path of the retaining member when the conveying unit is in the first position, the conveying unit being decoupled from the storage member and no longer positioned in the path of the retaining member when the conveying unit is in the second position.

11. The image forming device according to claim 10, further comprising a plurality of photosensitive bodies provided in one-to-one correspondence with the plurality of developer accommodating members, wherein the retaining member is further configured to retain the plurality of photosensitive bodies.

12. The image forming device according to claim 11, wherein the plurality of photosensitive bodies is further configured to contact the endless belt when the retaining member is in the internal position and to separate from the endless belt when the retaining member is in the external position.

13. The image forming device according to claim 11, wherein each of the plurality of photosensitive bodies is of an elongated shape extending in a longitudinal direction, the first cleaning unit including a first conveying member configured to convey the residual toner toward one longitudinal direction of the plurality of photosensitive bodies.

14. The image forming device according to claim 13, wherein the first conveying member is configured to be rotatable relative to the first cleaning unit; and wherein the conveying unit is configured to be rotatable about a rotational center of the first conveying member between the first position and the second position.

15. The image forming device according to claim 11, wherein the storage member is disposed on a downstream side of the plurality of the photosensitive bodies in a direction from the internal position to the external position.

16. The image forming device according to claim 10, wherein the second roller is disposed downstream, side of the first roller in a direction from the internal position to the external position; and wherein the first cleaning member confronts the second roller.

17. The image forming device according to claim 10, wherein the storage member is integrally provided with a farthest downstream one of the plurality of developer accommodating members, the farthest downstream one of the plurality of developer accommodating members being disposed farthest downstream in a direction from the internal position to the external position, the storage member and the farthest downstream one of the plurality of developer accommodating members being integrally mounted in and removable from the retaining member.

18. The image forming device according to claim 17, wherein the storage member is disposed on a downstream side of the farthest downstream one of the plurality of developer accommodating members in the direction from the internal position to the external position, and disposed in a side-by-side fashion with respect to a farthest downstream one of the plurality of photosensitive drums, the farthest downstream one of the plurality of photosensitive drums being disposed farthest downstream in a direction from the internal position to the external position.

19. An image forming device comprising:

a main body;

a plurality of photosensitive bodies arranged in parallel to one another and spaced apart with a predetermined distance between adjacent photosensitive bodies, a developer image being formable on each of the plurality of photosensitive bodies;

a retaining member configured to retain the plurality of photosensitive bodies and be movable between an internal position inside the main body and an external position outside the main body;

a belt unit that includes:

a first roller;

a second roller arranged in parallel to the first roller and, spaced apart a predetermined distance from the first roller in a first direction in which the plurality of photosensitive bodies is arranged; and an endless belt looped around the first roller and the second roller and configured to contact the plurality of photosensitive bodies when the retaining member is in the internal position and to separate from the plurality of photosensitive bodies when the retaining member is in the external position;

a first cleaning unit includes:

a first cleaning member fixedly positioned and configured to remove residual toner on the endless belt;

a storage member supported by the retaining member and configured to store the residual toner removed by the first cleaning unit; and a conveying unit configured to convey the residual toner removed by the first cleaning unit to the storage member, wherein the conveying unit is further configured to be movable between a first position, and a second position, the conveying unit being coupled to the storage member when the conveying unit is in the first position, the conveying unit being decoupled from the storage member when the conveying unit is in the second position, and wherein the second position is disposed nearer to the endless belt than the first position in a second direction in which the endless belt confronts each of the plurality of photosensitive bodies, the second direction being orthogonal to the first direction.

* * * * *